United States Patent [19]

Karino et al.

[11] 4,123,275

[45] Oct. 31, 1978

[54] COLOR DIFFUSION TRANSFER PHOTOGRAPHIC MATERIALS WITH VINYL COPOLYMER NEUTRALIZATION RATE CONTROLLING LAYER

[75] Inventors: Yukio Karino; Shinji Sakaguchi; Takashi Yoshida, all of Minami Ashigara, Japan

[73] Assignee: Fuji Photo Film Co., Ltd., Minami Ashigara, Japan

[21] Appl. No.: 708,973

[22] Filed: Jul. 26, 1976

[30] Foreign Application Priority Data

Jul. 24, 1975 [JP] Japan ..... 50/90616

[51] Int. Cl.[2] ..... G03C 7/00; G03C 5/54; G03C 1/40

[52] U.S. Cl. ..... 96/77; 96/3; 96/29 D

[58] Field of Search ..... 96/3, 29 D, 77, 74, 96/73

[56] References Cited

U.S. PATENT DOCUMENTS

| | | | |
|---|---|---|---|
| B 351,673 | 1/1975 | Fleckenstein et al. | 96/77 |
| 3,421,893 | 1/1969 | Taylor | 96/77 |
| 3,615,422 | 10/1971 | Hablerin | 96/77 |
| 3,847,615 | 11/1974 | Yoshida et al. | 96/77 |

*Primary Examiner*—Richard L. Schilling
*Attorney, Agent, or Firm*—Sughrue, Rothwell, Mion, Zinn and Macpeak

[57] ABSTRACT

In a color diffusion transfer photographic material comprising a photosensitive element including at least one light-sensitive silver halide emulsion layer having a dye image providing material associated therewith, an image receiving element for fixing the diffusible dye formed from said dye image providing material to form a dye image, an alkaline processing composition capable of developing the exposed photosensitive element, and, if necessary, a hydrophilic colloid layer, the photographic material further having neutralizing means for reducing the pH of the alkaline processing composition. The stability of the transferred dye image formed in the image receiving element is improved by incorporating in the neutralization rate controlling layer of the neutralizing means a copolymer of a vinyl compound and an unsaturated monomer, said copolymer having the recurring structural unit represented by the general formula:

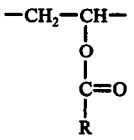

wherein R represents a hydrogen atom, an aliphatic group having 1 to 10 carbon atoms, or an aryl group.

18 Claims, No Drawings

COLOR DIFFUSION TRANSFER PHOTOGRAPHIC MATERIALS WITH VINYL COPOLYMER NEUTRALIZATION RATE CONTROLLING LAYER

BACKGROUND OF THE INVENTION

1. Field of the Invention

The present invention generally relates to color diffusion transfer photography, and, more particularly, to photographic materials adapted for forming color transfer images by a color diffusion transfer photographic process.

2. Description of the Prior Art

A color diffusion transfer photographic material is generally composed of (1) a photosensitive element having three kinds of units (corresponding to the three principle colors) each comprising a combination of a light-sensitive silver halide emulsion layer and a dye image providing material associated therewith for providing a diffusible dye, (2) a processing element containing a liquid processing composition (an alkaline aqueous solution or aqueous dispersion) capable of developing the exposed photosensitive element and diffusing a diffusible dye formed from the dye image providing material, and (3) an image receiving element including an image receiving layer capable of image-wise receiving the diffused dye.

One of the features of a diffusion transfer color photographic material is that a natural color photographic print is obtained immediately after photography, and to utilize this feature effectively, an "instant photographic processing" mechanism which does not require stabilization processings (such as washing and fixing of color images after development), which is quite different from conventional color photography, is associated with the photographic material.

Since in color diffusion transfer photographic process a washing step and a fixing step are not employed, it is necessary, to achieve stable color images, to provide a means in the color photographic material for automatically stabilizing the color images.

As one stabilizing means for color images, it is known to place a neutralizing means in the color photographic material. That is, by employing a neutralizing means in the photographic material, alkaline components and salt forming reagents in a processing composition are absorbed therein after development to remove factors which destroy or change the color images formed.

Various means have been proposed to achieve the above as described in, for example, U.S. Pat. Nos. 3,362,819, 3,575,701 and 3,455,686. These attempts fundamentally employ a system where an acid polymer layer is formed on a support and a neutralization rate controlling layer (this layer is hereinafter referred to as a "timing layer") is formed on the acid polymer layer. In this system, the acid polymer layer acts to absorb the alkaline components and salt forming reagents in the processing composition while the timing layer acts to delay the start of the action of the acid polymer layer to prevent insufficient development caused by too fast an action of the acid polymer layer.

In addition, as materials for the timing layer, inert polymers or copolymers such as polyvinyl alcohol, partial acetalized products of polyvinyl alcohol, copolymers of vinyl acetate and vinyl alcohol, polyvinyl acetate (homopolymer), and gelatin, as well as a polyvinyl amide graft copolymers, have been used. The neutralizing means using such a polymer or copolymer shows the characteristic that the amounts of water, alkaline components, and salt forming reagents passing through the timing layer during development are passing at almost the same rate, and, as a result thereof, the pH in the image receiving layer and the photosensitive layer is quickly reduced.

If the pH of these layers is quickly reduced, it becomes difficult to sufficiently maintain the necessary pH for development, which results in making it difficult to provide a fast development rate as is required for practical purposes. On the other hand, if the pH is slowly reduced, it takes a comparatively long time to reach a stable pH region (i.e., 5 to 7, preferably 6 to 7) for the color images, and, thus, the color images tend to be stained (image stability is lost).

SUMMARY OF THE INVENTION

As a result of various investigations, the inventors have discovered that a certain kind of copolymer (in particular, a hydrolyzed copolymer) capable of controlling changes in pH in the image receiving layer and the photosensitive layer with the passage of time during development provides a high image density, high development speed, and a high image stability, prevents the formation of stains, and, further, improves the resolving power, the sharpness, and the color reproducibility of the photographic materials.

One object of this invention is, therefore, to provide a color diffusion transfer photographic material having an improved neutralizing means capable of providing dye images having improved image density, resolving power, sharpness, and color reproducibility.

Another object of this invention is to provide a color diffusion transfer photographic material with improved developing speed.

Still another object of this invention is to provide a color diffusion transfer photographic material capable of providing color images having excellent preservative or storage stability which forms less stains.

The above objects of this invention can be attained by the present invention which provides a color diffusion transfer photographic material comprising a photosensitive element including at least one light-sensitive silver halide emulsion layer and a dye image providing material associated therewith, an image receiving element for fixing a diffusible dye formed from the dye image providing material to form a dye image therein, an alkaline processing composition capable of developing the exposed photosensitive element, and, if desired, a hydrophilic colloid layer, the photographic material further having neutralizing means for reducing the pH of the alkaline processing composition, the neutralizing means having a neutralization rate controlling layer containing a copolymer of at least one vinyl compound and at least one unsaturated monomer addition polymerizable with the vinyl compound, the copolymer having the recurring structural unit represented by general formula (I):

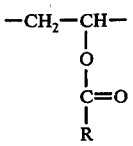

(I)

wherein R represents a hydrogen atom, an aliphatic group having 1 to 10 carbon atoms, or an aryl group.

The present invention can be more effectively applied to systems using pH indicator type dye image providing materials showing preferred absorption spectra at a neutral pH as described in Japanese Patent Application 125,813/73.

DETAILED DESCRIPTION OF THE INVENTION

As described above, R of general formula (I) represents a hydrogen atom, an aliphatic group having 1 to 10 carbon atoms, or an aryl group preferably having 6 to 10 carbon atoms, wherein the aliphatic group or the aryl group can be substituted, if desired. In the case that the aryl group has a substituent, examples of the substituent are a halogen atom (e.g., fluorine, chlorine, etc.), a cyano group, an alkoxy group (preferably having 1 to 4 carbon atoms, e.g., a methoxy group, ethoxy group, etc.), an aryl group, preferably having 6 to 10 carbon atoms, a hydroxy group, an acyl group (preferably having 1 to 4 carbon atoms, e.g., an acetyl group, etc.), a sulfo group, and an amino group.

The copolymer possessing the recurring structural unit represented by general formula (I) can be prepared by the copolymerization of a vinyl compound (monomer) shown by general formula (IA):

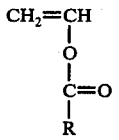

(IA)

wherein R has the same significance as in general formula (I), and an unsaturated monomer which is addition polymerizable with the vinyl compound. Considering the stability and hydrolysis rate of the copolymer, it is preferred that R be an aliphatic group having 1 to 6 carbon atoms, in particular, an aliphatic group having 1 to 4 carbon atoms.

Specific examples of monomers shown by general formula (IA) are vinyl formate, vinyl acetate, vinyl propionate, vinyl butyrate, vinyl isobutyrate, vinyl dimethylpropionate, vinyl ethylbutyrate, vinyl valerate, vinyl caproate, vinyl chloroacetate, vinyl dichloroacetate, vinyl trichloroacetate, vinyl chlorodifluoroacetate, vinyl trifluoroacetate, vinyl cyanoacetate, vinyl methoxyacetate, vinyl butoxyacetate, vinyl phenylacetate, vinyl acetoacetate, vinyl-2-chloropropionate, vinyl lactate, vinyl-$\beta$-phenylbutyrate, vinyl hexacyclohexycarboxylate, vinyl benzoate, vinyl salicylate, vinyl chlorobenzoate, vinyl 2,4-dichlorobenzoate, vinyl tetrachlorobenzoate, and vinyl naphthoate.

As the unsaturated monomer addition polymerizable with the vinyl compound, there can be exemplified unsaturated monomers addition polymerizable with general vinyl compounds, such as acrylic acids, acrylamides, methacrylic acids, methacrylamides, allyl compounds, vinyl ethers, vinyl esters, vinyl heterocyclic compounds, styrenes, maleic acids, fumaric acids, itaconic acids, olefins, crotonic acids, vinyl ketones, halogenated olefins, halogenated acrylic acids, unsaturated nitriles, sorbic acids, $\alpha,\beta$-unsaturated dicarboxylic acids, N-vinylamides, cinnamic acids, etc.

Specific examples of such comonomers are acrylic acids such as acrylic acid and acrylates (wherein when the acrylates or the methacrylates shown below are esters of an aliphatic hydrocarbon residue (e.g., an alkyl group, etc.) having 2 to 8 carbon atoms, the aliphatic hydrocarbon group residue is an unsubstituted group or the aliphatic hydrocarbon group substituted by a halogen atom, cyano group, hydroxy group, acyl group, preferably having 1 to 4 carbon atoms, sulfo group, amino group, carboxy group, aryl group, preferably having 6 to 10 carbon atoms, aryloxy group, preferably having 6 to 10 carbon atoms, or alkoxy group (preferably having 1 to 6 carbon atoms, where the alkoxy group may also have a substituent as just enumerated)), e.g., methyl acrylate, ethyl acrylate, n-propyl acrylate, isopropyl acrylate, n-butyl acrylate, isobutyl acrylate, sec-butyl acrylate, amyl acrylate, hexyl acrylate, 2-ethylhexyl acrylate, octyl acrylate, tert-octyl acrylate, 2-phenoxyethyl acrylate, 2-chloroethyl acrylate, 2-bromoethyl acrylate, 4-chlorobutyl acrylate, cyanoethyl acrylate, dimethylaminoethyl acrylate, benzyl acrylate, methoxybenzyl acrylate, 2-chlorocyclohexyl acrylate, cyclohexyl acrylate, furfuryl acrylate, tetrahydrofurfuryl acrylate, phenyl acrylate, 2-hydroxyethyl acrylate, 3-hydroxypropyl acrylate, 2-hydroxypropyl acrylate, 2,3-dihydroxypropyl acrylate, 4-hydroxybutyl acrylate, 5-hydroxypentyl acrylate, 2,2-dimethyl-3-hydroxypropyl acrylate, diethyleneglycol monoacrylate, triethylene glycol monoacrylate, dipropylene glycol monoacrylate, glycerol monoacrylate, trimethylolethane monoacrylate, trimethylolpropane monoacrylate, pentaerythritol monoacrylate, 2-methoxyethyl acrylate, 3-methoxybutyl acrylate, 2-ethoxyethyl acrylate, 2-iso-propoxyethyl acrylate, 2-butoxyethyl acrylate, 2-(2-methoxyethoxy)ethyl acrylate, 2-(2-butoxyethoxy)ethyl acrylate, $\omega$-methoxypolyethylene glycol acrylate (the number of ethylene glycol radicals per molecule is equal to 9; hereafter addition mole number $n = 9$), $\omega$-methoxypolyethylene glycol acrylate (addition mole number $n = 23$), $\omega$-lauroxypolyethylene glycol acrylate (addition mole number $n = 20$), 1-bromo-2-methoxyethyl acrylate, 1,1-dichloro-2-ethoxyethyl acrylate, 2-hydroxy-3-chloropropyl acrylate, etc.; methacrylic acids such as methacrylic acid and methacrylates which include esters of an aliphatic group, an aryl group, and the like, e.g., methyl methacrylate, ethyl methacrylate, n-propyl methacrylate, iso-propyl methacrylate, n-butyl methacrylate, iso-butyl methacrylate, sec-butyl methacrylate, amyl methacrylate, hexyl methacrylate, cyclohexyl methacrylate, benzyl methacrylate, chlorobenzyl methacrylate, octyl methacrylate, sulfopropyl methacrylate, N-ethyl-N-phenylaminoethyl methacrylate, 2-(3-phenylpropyloxy)ethyl methacrylate, dimethyl aminophenoxyethyl methacrylate, furfuryl methacrylate, tetrahydrofurfuryl methacrylate, phenyl methacrylate, cresyl methacrylate, naphthyl methacrylate, 2-hydroxyethyl methacrylate, 3-hydroxypropyl methacrylate, 2-hydroxypropyl methacrylate, 2,3-dihydroxypropyl methacrylate, 4-hydroxybutyl methacrylate, 5-hydroxypentyl methacrylate, 2,2-dimethyl-3-hydroxypropyl methacrylate, diethylene glycol monomethacrylate, triethylene glycol monomethacrylate, dipropylene glycol monomethacrylate, glycerol monomethacrylate, trimethylolethane monomethacrylate, trimethylolpropane monomethacrylate, pentaerythritol monomethacrylate, 2-methoxyethyl methacrylate, 3-methoxybutyl methacrylate, 2-ethoxyethyl methacrylate, 2-iso-propoxyethyl methacrylate, 2-butoxyethyl methacrylate, 2-(2-methoxyethoxy)ethyl methacrylate, 2-(2-ethoxyethoxy)ethyl methacrylate, 2-(2-butoxyethoxy)ethyl methacrylate, ω-methoxypolyethylene glycol methacrylate (addition mole number $n = 6$), ω-methoxypolyethylene glycol methacrylate (addition mole number $n = 23$), ω-lauroxypolyethylene glycol methacrylate (addition mole number $n = 20$), 1-bromo-2-methoxyethyl methacrylate, 1,1-dichloro-2-ethoxyethyl methacrylate, 2-hydroxy-3-chloropropyl methacrylate, etc.; acrylamides such as acrylamide and N-substituted acrylamides, wherein the substituent is an aliphatic group, preferably having 1 to 8 carbon atoms (e.g., an unsubstituted alkyl group, a substituted alkyl group having a hydroxy, alkoxy, cyano, aryl, heterocyclic radical, carboxy, acetamido, sulfo or the like as a substituent), an aryl group, preferably having 6 to 10 carbon atoms, an acyl group, an amino group and the like, or the substituents may join with each other to form a nitrogen-containing heterocyclic group having, for example, 6- or 7-membered ring, e.g., methylacrylamide, ethylacrylamide, propylacrylamide, iso-propylacrylamide, butylacrylamide, tert-butylacrylamide, heptylacrylamide, tert-octylacrylamide, cyclohexylacrylamide, benzylacrylamide, hydroxymethylacrylamide, methoxyethylacrylamide, dimethylaminoethylacrylamide, hydroxyethylacrylamide, phenylacrylamide, hydroxyphenylacrylamide, tolylacrylamide, naphthylacrylamide, 2-acrylamide-2-methylpropanesulfonic acid, dimethylacrylamide, diethylacrylamide, dibutylacrylamide, di-iso-butylacrylamide, N-(1,1-dimethyl-3-oxobutyl)acrylamide, methylbenzylacrylamide, benzyloxyethylacrylamide, β-cyanoethylacrylamide, acryloylmorpholine, N-methyl-N-acryloylpiperazine, N-acryloylpiperidine, acryloylglycine, N-(1,1-dimethyl-3-hydroxybutyl)acrylamide, N-β-morpholinoethylacrylamide, N-acryloylhexamethyleneimine, N-hydroxyethyl-N-methylacrylamide, N-2-acetamidoethyl-N-acetylacrylamide, acrylhydrazine, etc.; methacrylamides such as methacrylamide and N-substituted methacrylamides, where preferred substituents are those as enumerated for the N-substituted acrylamide, e.g., methylmethacrylamide, tert-butylmethacrylamide, tert-octylmethacrylamide, benzylmethacrylamide, cyclohexylmethacrylamide, phenylmethacrylamide, dimethylmethacrylamide, diethylmethacrylamide, dipropylmethacrylamide, hydroxyethyl-N-methylmethacrylamide, N-methyl-N-phenylmethacrylamide, N-ethyl-N-phenylmethacrylamide, methacrylhydrazine, etc.; allyl compounds such as allyl esters, e.g., allyl acetate, allyl caproate, allyl caprylate, allyl laurate, allyl palmitate, allyl stearate, allyl benzoate, allyl acetoacetate, allyl lactate, β-allyloxy ethyl alcohol, allylbutyl ether, allylphenyl ether, etc.; vinyl ethers such as alkyl vinyl ethers, substituted alkyl vinyl ethers wherein the substituent is a halogen atom, a hydroxy group, an alkoxy group, an amino group, an aryl group, a heterocyclic group or the like and aryl vinyl ethers, e.g., methyl vinyl ether, butyl vinyl ether, hexyl vinyl ether, octyl vinyl ether, decyl vinyl ether, ethylhexyl vinyl ether, methoxyethyl vinyl ether, ethoxyethyl vinyl ether, chloroethyl vinyl ether, 1-methyl-2,2-dimethylpropyl vinyl ether, 2-ethylbutyl vinyl ether, hydroxyethyl vinyl ether, diethylene glycol vinyl ether, dimethylaminoethyl vinyl ether, diethylaminoethyl vinyl ether, butylaminoethyl vinyl ether, benzyl vinyl ether, tetrahydrofurfuryl vinyl ether, vinyl phenyl ether, vinyl tolyl ether, vinyl chlorophenyl ether, vinyl-2,4-dichlorophenyl ether, vinylnaphthyl ether, vinylanthranyl ether, etc.; vinyl esters such as esters of vinyl alcohol with an aliphatic acid or aromatic acid, e.g., vinyl formate, vinyl acetate, vinyl propionate, vinyl butyrate, vinyl iso-butyrate, vinyl dimethylpropionate, vinyl ethylbutyrate, vinyl valerate, vinyl caproate, vinyl chloroacetate, vinyl dichloroacetate, vinyl methoxyacetate, vinyl butoxyacetate, vinyl phenylacetate, vinyl acetoacetate, vinyl lactate, vinyl-β-phenyl butyrate, vinyl cyclohexylcarboxylate, vinyl benzoate, vinyl salicylate, vinyl chlorobenzoate, vinyl tetrachlorobenzoate, vinyl naphthoate, etc.; vinyl heterocyclic compounds wherein the heterocyclic ring includes, for example, an unsaturated or saturated nitrogen, oxygen or sulfur-containing 5 to 7 membered ring which may be condensed, such as N-vinyloxazolidone, vinylpyridine, vinylpicoline, N-vinylimidazole, N-vinyl-2-methylimidazole, N-vinyltriazole, N-vinyl-3,5-dimethyltriazole, N-vinylpyrrolidone, N-vinyl-3,5-dimethylpyrazole, N-vinylcarbazole, vinylthiophene, N-vinylsuccinimide, N-vinylglutarimide, N-vinyladipimide, N-vinylpiperidone, N-vinyl-ε-caprolactam, N-vinyl-2-pyridone, etc.; styrenes such as unsubstituted styrenes and substituted styrenes wherein the substituent is an aliphatic group (e.g., an unsubstituted alkyl group, a substituted alkyl group having, for example, aryl, halogen, alkoxy, acyloxy or the like as a substituent, etc.), a halogen atom, a carboxy group, an alkoxycarbonyl group and the like, e.g., styrene, methylstyrene, dimethylstyrene, trimethylstyrene, ethylstyrene, diethylstyrene, iso-propylstyrene, butylstyrene, hexylstyrene, cyclohexylstyrene, decylstyrene, benzylstyrene, chloromethylstyrene, trifluoromethylstyrene, ethoxymethylstyrene, acetoxymethylstyrene, methoxystyrene, 4-methoxy-3-methylstyrene, dimethoxystyrene, chlorostyrene, dichlorostyrene, trichlorostyrene, tetrachlorostyrene, pentachlorostyrene, bromostyrene, dibromostyrene, iodostyrene, fluorostyrene, trifluorostyrene, 2-bromo-4-trifluoromethylstyrene, 4-fluoro-3-trifluoromethylstyrene, vinylbenzoic acid, vinyl benzoic acid methyl ester, etc.; crotonic acids such as crotonic acid, crotonic acid amide, and crotonic acid esters, e.g., butyl crotonate, hexyl crotonate, glycerol monocrotonate, etc.; vinyl ketones such as aliphatic vinyl ketone and aromatic vinyl ketone, e.g., methyl vinyl ketone, phenyl vinyl ketone, methoxy ethyl vinyl ketone, etc.; olefins such as dicyclopentadiene, ethylene, propylene, 1-butene, 1-pentene, 1hexene, 4-methyl-1-pentene, 1-heptene, 1-octene, 1-decene, 5-methyl-1-nonene, 5,5-dimethyl-1-octene, 4-methyl-1-hexene, 4,4-dimethyl-1-pentene, 5-methyl-1-hexene, 4-methyl-1-heptene, 5-methyl-1-heptene, 4,4-dimethyl-1-hexene, 5,5,6-trimethyl-1-heptene, 1-dodecene, 1-octadecene, etc.; itaconic acid such as itaconic acid, itaconic anhydride, methyl itaconate, ethyl itaconate, diethyl itaconate, dibutyl itaconate, etc.; sorbic acids such as sorbic acid, methyl sorbate, etc.; α,β-unsaturated dicarboxylic acids such as citraconic acid, mesaconic acid, etc.; N-vinyl amides such as N-methyl-N-vinylformamide, N-ethyl-N-vinylformamide, N-methyl-N-vinylacetamide, N-ethyl-N-vinylacetamide, N-methyl-N-vinylpropionamide, etc.; cinnamic acids such as cinnamic acid, etc.; halogenated acrylic acids such as chloroacrylic acid, etc.; maleic acids such as maleic acid, maleic anhydride, ethyl maleate, butyl maleate, dibutyl maleate, octyl maleate, etc.; fumaric acids such as ethyl fumarate, hexyl fumarate, dibutyl fumarate, octyl fumarate, etc.; halogenated olefins, preferably having 2 to 6 carbon atoms such as vinyl chloride, vinylidene chloride, chloroprene, etc.; unsaturated nitriles, preferably having 3 to 4 carbon atoms such as acrylonitrile, methacrylonitrile, etc. If desired or necessary, two or more kinds of these materials may be used.

Considering from the viewpoint of solubility, transparency, oleophilicity, hydrophilicity, rate of hydrolysis, affinity to adjacent layers, etc., the hydroxylalkyl acrylates, hydroxyalkyl methacrylates, vinyl heterocyclic compounds, acrylamides, and methacrylamides are particularly preferred.

There is no particular restriction on the component ratio of the copolymer having the recurring structural unit represented by general formula (I), but it is preferred that the proportion of the component shown by general formula (I) be about 40 to 98 mol%, in particular, 50 to 95 mol%, in more particular, 65 to 95 mol%.

It should be noted that the above percentage limitation is not to be construed as an undue restriction upon the present invention so long as the effects of the compounds of the present invention as above described are exhibited. It is most preferred, in this regard, that the effective molecular weight of any copolymer containing the above units have a molecular weight of at least about $5 \times 10^3$, and, of course, as indicated, that the proportion of the recurring units be at least about 40 mol%.

Copolymers having the recurring structural units represented by general formula (I) may be conveniently prepared according to the methods described in, for example, British Pat. No. 1,211,039, Japanese Patent Publication No. 29,195/72, Japanese Patent Applications Nos. 7,174/72, 23,466/72, 59,743/72 and 31,355/73, British Pat. No. 961,395, U.S. Pat. Nos. 3,227,672, 3,290,417, 3,262,919, 3,245,932, 2,681,897, and 3,230,275, John C. Petropoulos et al., *Official Digest*, 33, 719–736 (1961), and Shunsuke Murahashi et al., *Gosei Kobunshi* (*Synthetic Polymers*), 1, 246–290, and 3, 1–108. The kinds of polymerization initiators, the concentration of the initiators, the polymerization temperature, and the reaction period of time employed may, as a matter of course, be changed according to the desired type of product.

For example, the polymerization can be carried out at 20° to 180° C., preferably 40° to 120° C. The polymerization reaction is usually performed using a radical polymerization initiator in an amount of 0.05 to 5% by weight of the monomers to be polymerized. Examples of the initiator employed in the polymerization reaction are azobis compounds, peroxides, hydroperoxides, redox catalysts, etc., such as, for example, potassium persulfate, tert-butyl peroctoate, benzoyl peroxide, isopropyl percarbonate, 2,4-dichlorobenzoyl peroxide, methyl ethyl ketone peroxide, cumene hydroperoxide, dicumyl peroxide, azobis-isobutyronitrile, etc.

The polymer used in this invention has usually a molecular weight of more than about 5,000, preferably of 10,000 to 1,000,000, although such is not overly critical.

Specific examples of copolymers having the recurring structural unit shown by general formula (I) are as follows:

(1) Copolymer of vinyl acetate and acrylamide (mole ratio of 75:25)
(2) Copolymer of vinyl acetate and dimethyl acrylamide (mole ratio of 70:30)
(3) Copolymer of vinyl acetate and methyl acrylamide (mole ratio of 90:10)
(4) Copolymer of vinyl acetate and tert-butyl acrylamide (mole ratio of 80:20)
(5) Copolymer of vinyl acetate and N-(1,1-dimethyl-3-oxobutyl)acrylamide (mole ratio of 70:30)
(6) Copolymer of vinyl acetate and N-(1,1-dimethyl-3-hydroxybutyl)acrylamide (mole ratio of 75:25)
(7) Copolymer of vinyl acetate and diethylacrylamide (mole ratio of 65:35)
(8) Copolymer of vinyl acetate and p-hydroxyphenyl acrylamide (mole ratio of 72:28)
(9) Copolymer of vinyl acetate and methacrylamide (mole ratio of 70:30)
(10) Copolymer of vinyl acetate and hydroxyethyl methacrylamide (mole ratio of 80:20)
(11) Copolymer of vinyl acetate and N-(1,1-dimethyl-3-hydroxybutyl)methacrylate (mole ratio of 75:25)
(12) Copolymer of vinyl acetate and 2-hydroxyethyl acrylate (mole ratio of 90:10)
(13) Copolymer of vinyl acetate and 2-hydroxypropyl acrylate (mole ratio of 85:15)
(14) Copolymer of vinyl acetate and trimethylolpropane monoacrylate (mole ratio of 95:5)
(15) Copolymer of vinyl acetate and diethylene glycol monoacrylate (mole ratio of 90:10)
(16) Copolymer of vinyl acetate and methoxyethyl acrylate (mole ratio of 73:27)
(17) Copolymer of vinyl acetate and methoxyethoxyethyl acrylate (mole ratio of 75:25)
(18) Copolymer of vinyl acetate and 2-hydroxyethyl methacrylate (mole ratio of 70:30)
(19) Copolymer of vinyl acetate and trimethylolpropane monomethacrylate (mole ratio of 85:15)
(20) Copolymer of vinyl acetate and N-acryloyl-N'-methylpiperazine (mole ratio of 80:20)
(21) Copolymer of vinyl acetate and N-acryloylpiperidine (mole ratio of 84:16)
(22) Copolymer of vinyl acetate and N-acryloylmorpholine (mole ratio of 90:10)
(23) Copolymer of vinyl acetate and N-methacryloyl-N'-ethylpiperazine (mole ratio of 65:35)
(24) Copolymer of vinyl acetate and sodium acrylate (mole ratio of 95:5)
(25) Copolymer of vinyl acetate and sodium acryloyloxypropylsulfonate (mole ratio of 93:7)
(26) Copolymer of vinyl acetate and potassium 2-acrylamide-2-methylpropanesulfonate (mole ratio of 95:5)
(27) Copolymer of vinyl acetate and N-vinyl pyrrolidone (mole ratio of 70:30)
(28) Copolymer of vinyl acetate and N-vinyloxazolidone (mole ratio of 90:10)
(29) Copolymer of vinyl acetate and N-vinyl-2-methylimidazole (mole ratio of 95:5)
(30) Copolymer of vinyl acetate and N-vinyl pyrrolidone (mole ratio of 90:10)
(31) Copolymer of vinyl acetate and N-vinyl-3,5-dimethyltriazole (mole ratio of 92:8)
(32) Copolymer of vinyl acetate and N-vinyl-3,5-dimethylpyrazole (mole ratio of 94:6)
(33) Copolymer of vinyl acetate and N-vinyl pyrrolidone (mole ratio of 80:20)
(34) Copolymer of vinyl acetate and N-vinyl succinimide (mole ratio of 86:14)
(35) Copolymer of vinyl acetate and potassium styrenesulfonate (mole ratio of 77:23)
(36) Copolymer of vinyl acetate and N-vinyl piperidone (mole ratio of 78:22)
(37) Copolymer of vinyl acetate and N-vinyl-ε-caprolactam (mole ratio of 80:20)
(38) Copolymer of vinyl acetate and N-vinyl-N-methylacetamide (mole ratio of 92:8)

(39) Copolymer of vinylchloroacetate and butyl acrylate (mole ratio of 88:12)
(40) Copolymer of vinyl trifluoroacetate and butyl methacrylate (mole ratio of 92:8)
(41) Copolymer of vinyl propionate and 2-hydroxyethyl acrylate (mole ratio of 65:35)
(42) Copolymer of vinyl valerate and N-vinyl pyrrolidone (mole ratio of 60:40)
(43) Copolymer of vinyl pivalate and acrylamide (mole ratio of 87:13)
(44) Copolymer of vinyl pivalate and ethoxyethyl methacrylate (mole ratio of 93:7)
(45) Copolymer of vinyl benzoate and N-vinyl-2-methylimidazole (mole ratio of 90:10)
(46) Copolymer of vinyl salicylate and N-vinyl-3,5-dimethyltriazole (mole ratio of 85:15)
(47) Copolymer of vinyl acetate, butyl methacrylate, and 2-hydroxyethyl acrylate (mole ratio of 70:5:25)
(48) Copolymer of vinyl acetate, ethyl methacrylate, and N-vinyl pyrrolidone (mole ratio of 60:10:30)
(49) Copolymer of vinyl acetate, tetrahydrofurfuryl acrylate, and N-acryloylmorpholine (mole ratio of 70:5:25)
(50) Copolymer of vinyl acetate, tert-butylacrylamide, and N-(1,1-dimethyl-3-hydroxybutyl)acrylamide (mole ratio of 75:10:15)
(51) Copolymer of vinyl acetate, 2-hydroxyethyl methacrylate, and N-vinyl succinimide (mole ratio of 80:10:10)
(52) Copolymer of vinyl acetate, methylstyrene, and p-hydroxystyrene (mole ratio of 80:5:15)
(53) Copolymer of vinyl acetate, hydroxymethylstyrene, and sodium maleate (mole ratio of 75:15:10)
(54) Copolymer of vinyl acetate, vinyl pivalate, and N-vinyl pyrrolidone (mole ratio of 50:40:10)
(55) Copolymer of vinyl acetate, vinyl chloroacetate, and 2-hydroxyethyl acrylate (mole ratio of 70:15:15)
(56) Copolymer of vinyl acetate, vinyl benzoate, and N-vinylimidazole (mole ratio of 60:20:20)
(57) Copolymer of vinyl benzoate, 2-hydroxyethyl methacrylate, and ethylacrylamide (mole ratio of 70:20:10)
(58) Copolymer of vinyl pivalate, 2-ethylhexyl acrylate, and 2-hydroxyethyl methacrylate (mole ratio of 75:5:20)
(59) Copolymer of vinyl chloroacetate, butyl acrylate, and dimethylacrylamide (mole ratio of 80:5:15)
(60) Copolymer of vinyl chloroacetate, vinyl pivalate, and diethylacrylamide (mole ratio of 50:40:10)
(61) Copolymer of vinyl acetate, vinyl pivalate, 2-hydroxyethyl acrylate, and tert-butylacrylamide (mole ratio of 60:20:10:10)

The above described copolymer for the timing layer in this invention is used together and associated with a neutralizing layer for reducing the pH of an image receiving layer for diffusible dyes after spreading an alkaline processing composition and is disposed between the neutralizing layer and the spread alkaline processing composition. Practical embodiments of the disposition of the timing layer are as follows: (1) a system in which at least a neutralizing layer, a timing layer of the copolymer, and a photosensitive layer having associated therewith a duffusible dye providing material are formed on a support in this order and an alkaline processing composition is spread between the photosensitive layer and an image receiving element comprising a support having coated thereon a diffusible dye receiving layer, the image receiving element being in a superposed relationship with the photosensitive layer; (2) a system in which at least a neutralizing layer, a timing layer of the copolymer, a diffusible dye receiving layer, a white reflecting layer, and a photosensitive layer having associated therewith a diffusible dye providing material are formed in this order on a support and an alkaline processing composition is spread between the photosensitive layer and another support superposed thereon; more preferably, (3) a system in which at least a neutralizing layer, a timing layer of the copolymer, and a diffusible dye receiving layer are formed in this order on a support and an alkaline processing composition is spread between the diffusible dye receiving layer and a photosensitive element comprising a support having formed thereon a photosensitive layer having associated therewith a diffusible dye providing material, the photosensitive element being in a superposed relationship with the diffusible dye receiving layer or (4) in which at least a diffusible dye receiving layer, a white reflecting layer, and a photosensitive layer having associated therewith a diffusible dye providing material are formed in the order on a support and an alkaline processing composition is spread between the photosensitive layer and a cover sheet comprising a support having coated thereon in this order at least a neutralizing layer and a timing layer of the copolymer. As a matter of course, the above illustrated embodiments are only typical examples, and, additional or auxiliary layers may, if desired or necessary, be formed.

The photographic materials of this invention may be of the "peel-apart" type wherein an image bearing element is separated after a definite period of time from the spreading of an alkaline processing composition or a "non-peel-apart" system wherein the color images formed are observed without the necessity of separating the image bearing element. Furthermore, when the copolymer of this invention is used in the timing layer, the copolymer(s) may be used alone or together with a plasticizer (generally used in an amount of 40 or less, preferably 20 or less, weight %, based on the copolymer) such as trialkyl phosphate, dibutyl phthalate, polyethylene glycol, etc., a cross-linking agent such as formaldehyde, trimethylol melamine, dimethylol urea, glyoxal, glutaraldehyde, etc., a polymer of an acrylic acid ester, a methacrylic acid ester, cellulose, etc., and, if desired or necessary, other additives according to the end use purpose of the photographic material. Moreover, the timing layer may have a multilayer structure and the copolymer used in this invention may be incorporated in at least one of the multilayer of the timing layer. Still further, an interlayer may be formed adjacent the timing layer to improve the adhesive property of the timing layer.

The copolymer used in this invention may be coated on a neutralizing layer as a solution thereof in a suitable solvent such as an alcohol, e.g., methanol, ethanol, isopropanol, etc.; a ketone, e.g., acetone, methyl ethyl ketone, diethyl ketone, cyclohexanone, etc.; an ester, e.g., methyl acetate, ethyl acetate, isopropyl acetate, n-butyl acetate, etc.; and an aromatic hydrocarbon such as benzene, toluene, xylene, etc., or a mixture of these organic solvents or further a mixture of the organic solvent and water.

At coating, the thickness of the copolymer layer must be selected considering factors such as the dye image providing material, the amount of alkali in the processing solution and the thickness of expansion due to the processing solution and is usually about 0.5 to about 30 microns, more preferably about 0.5 to 10 microns, although the thickness depends upon the structure and the composition of the copolymer layer used.

It is preferred that a film forming acid polymer be used as the acid polymer layer in this invention and preferred acid polymers used for the purpose have a molecular weight of from about 10,000 to about 100,000. Examples of such acid polymers are the monobutyl ester of a 1:1 copolymer of maleic anhydride and ethylene and the monobutyl ester of a 1:1 copolymer of maleic anhydride and methyl vinyl ether as described in U.S. Pat. No. 3,362,819, as well as the monoethyl ester, monopropyl ester, monopentyl ester and monohexyl ester of a 1:1 copolymer of maleic anhydride and ethylene; the monoethyl ester, monopropyl ester, monopentyl ester, and monohexyl ester of a 1:1 copolymer of maleic anhydride and methyl vinyl ether; copolymers of methacrylic acid and acrylic acid in any copolymerization ratios; polyacrylic acid; polymethacrylic acid; copolymers of acrylic acid or methacrylic acid and another vinyl monomer(s) in various copolymerization ratios, such as, for example, a copolymer of at least 30 mol%, preferably 50 to 90 mol% acrylic acid or methacrylic acid and an acrylic acid ester, a methacrylic acid ester, or a vinyl ether. Other useful acid polymers are disclosed in U.S. Pat. No. 3,756,815 and in Research Disclosure 12, 331, page 22. Among the above described polymers, polyacrylic acid is particularly preferred. Such an acid polymer is coated on a support as a solution thereof in a solvent such as an alcohol, e.g., methanol, ethanol, propanol, butanol, etc.; a ketone, e.g., acetone, methyl ethyl ketone, diethyl ketone, cyclohexanone, etc.; an ester, e.g., methyl acetate, ethyl acetate, isopropyl acetate, butyl acetate, etc.; and a mixture of these solvents.

The degree of acidity of any acid polymer layer used obviously depends upon the polymer selected. For example, and such is not to be construed as limitative, a polymer having a carboxy group most preferably exhibits a pH of about 5 to 6 and a polymer having a sulfo group most preferably exhibits a pH of about 1.

The thickness of the acid polymer layer depends upon the composition and amount of the processing composition employed and the kind of the acid polymer, but is generally 5 to 30 microns.

When a diffusible aromatic primary amino developing agent is used in the processing composition, it is effective, to reduce the formation of brown stains, to incorporate in an amount of about 0.5 to 10 g/m$^2$ a scavenger for the aromatic primary amino developing agent as described in Japanese Patent Application Nos. (OPI) 15,134/72, 5,424/73 and 3,836/73 in the timing layer, the neutralizing layer, the diffusible dye receiving layer, or, if necessary, another layer, or further to form a layer containing the scavenger.

Other materials used in the color diffusion transfer photographic materials of this invention will be explained below in detail.

As the dye image providing materials used together and associated with silver halide emulsions in the photosensitive elements of this invention, the following materials can be used, although the use of the diffusible dye releasing type couplers shown below is particularly preferred.

(a) Dye Developers: A dye developer is a compound having a dye moiety and a silver halide developing group in one molecule as described in U.S. Pat. No. 2,983,606. When the dye developer is applied to an exposed silver halide emulsion together with an alkali, the reduction of silver halide and the oxidation of the dye developer occur. The oxidized dye developer has a lower solubility and diffusibility in the processing composition than the original dye developer and is fixed near the reduced silver halide. In a preferred embodiment, the dye developer is substantially insoluble in an acid or neutral aqueous medium but has at least a dissociatable group which renders the dye developer soluble and diffusible in an alkaline processing composition. Such a dye developer may be incorporated in a photosensitive element, in particular in a silver halide emulsion layer or a layer adjacent thereto, and if dye images are transferred by diffusion from a photosensitive element having at least two photosensitive units, each comprising a silver halide emulsion layer having associated therewith a dye developer possessing the absorption characteristics corresponding to the light-sensitive wavelength region of the silver halide emulsion, to an image receiving element, a multicolor positive image can be obtained in the image receiving layer by one development processing. In this case, it is profitable to employ dye developers which have light absorptions that make it possible to reproduce color by a subtractive color process, that is, dye developers which give yellow, magenta, and cyan dyes. The dye moieties capable of giving these absorptions are derived from azo dyes, anthraquinone dyes, phthalocyanine dyes, nitro dyes, quinoline dyes, azomethine dyes, indamine dyes, indoaniline dyes, indophenol dyes, and azine dyes.

On the other hand, the silver halide developing group is a group which can develop a light-exposed silver halide, and it is preferred that the group loses its hydrophilic property as a result of the oxidation. In general, a benzenoid developing group, that is, an aromatic developing group which forms a quinoid when oxidized, is effectively used. A preferred developing group is a hydroquinonyl group and other examples of preferred developing groups are an o-dihydroxyphenyl group and an o- or p-amino-substituted hydroxyphenyl group.

In preferred dye developers, the dye moiety is isolated from the silver halide developing group by a saturated aliphatic group such as an ethylene group so that they are not electronically conjugated with each other. A 2-hydroquinonylethyl group or a 2-hydroquinonylpropyl group is particularly useful as a group having such a saturated aliphatic group connected with a developing group. The dye moiety may be connected to the developing group by a covalent bond or further may be connected to the developing group by a coordinate bond as shown in U.S. Pat. Nos. 3,551,406, 3,563,739, 3,597,200, and 3,674,478. Furthermore, according to the purpose and the construction of the color diffusion transfer photographic materials, it is profitable to temporarily convert the dye moiety of the dye developer into the colorless leuco form by reduction as shown in U.S. Pat. No. 3,320,063 or to temporarily shift the absorption of the dye developer to a shorter wavelength side by acylating the hydroxy group or amino group of the auxochrome as shown in U.S. Pat. Nos. 3,230,085 and 3,307,947. A dye developer which has a dye moiety having a hydroxy group at the ortho position of the azo bond is useful in the point that the absorption characteristics and the stability of the dye images formed are excellent, as shown in U.S. Pat. No. 3,299,041.

Other examples of dye developers suitably used in the diffusion transfer color photographic materials of this invention are described in U.S. Pat. Nos. 2,983,605, 2,992,106, 3,047,386, 3,076,808, 3,076,820, 3,077,402, 3,126,280, 3,131,061, 3,134,762, 3,134,765, 3,135,604, 3,135,605, 3,135,606, 3,135,734, 3,141,772, 3,142,565, 3,173,906, 3,183,090, 3,246,985, 3,230,086, 3,309,199, 3,230,083, 3,239,339, 3,347,672, 3,347,673, 3,245,790 and 3,230,082.

Specific examples of dye developers suitably used for the diffusion transfer color photographic materials of this invention are as follows:

4-[p-(β-Hydroquinonylethyl)phenylazo]-3-(N-n-hexylcarbamoyl)-1-phenyl-5-pyrazolone, 2-[p-(β-Hydroquinonylethyl)phenylazo]-4-isopropoxy-1-naphthol, 1,4-bis-[β-(hydroquinonyl-α-methyl)ethylamino]-5,8-dihydroxyanthraquinone,

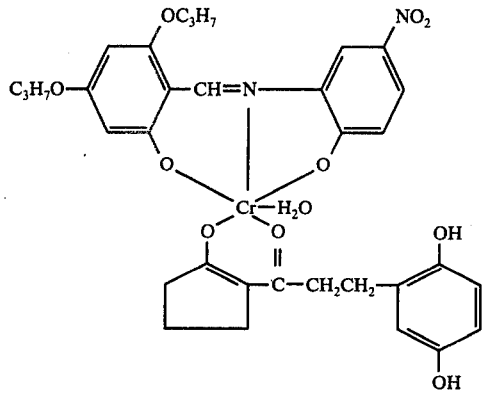

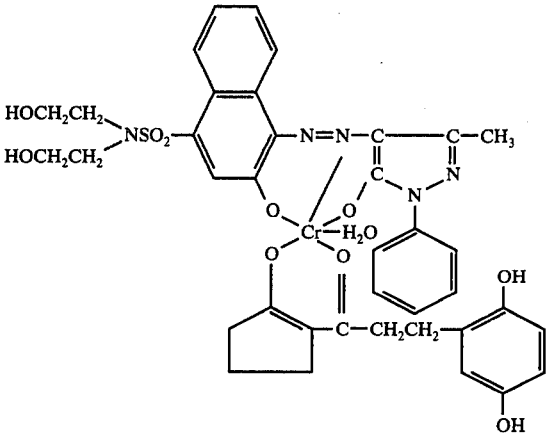

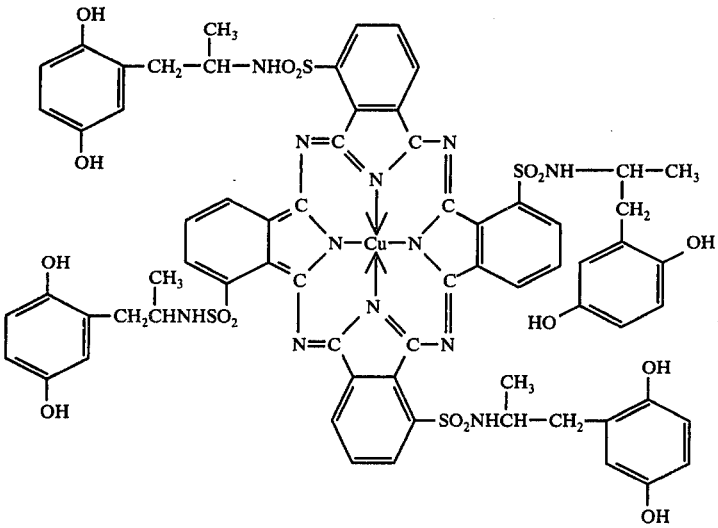

In diffusion transfer color photography wherein dye developers are used as dye image providing materials, it is profitable, to achieve rapid development, to use an auxiliary developing agent. For this purpose, developing agents such as 1-phenyl-3-pyrazolidones are described in U.S. Pat. No. 3,039,869; hydroquinone derivatives such as 4'-methylphenylhydroquinone and t-butylhydroquinone; or catechol derivatives as are described in U.S. Pat. No. 3,617,277 may be incorporated in the liquid processing composition or may be incorporated in the photosensitive element, in particular, in silver halide emulsion layers, the layers containing dye developers, interlayers, or the uppermost protective layer of the photosensitive element. Moreover, to promote the development and diffusion transfer, an onium compound such as N-benzyl-α-picolinium bromide as described in U.S. Pat. No. 3,173,786 may be present at development.

(b) Diffusible Dye Releasing Couplers: A diffusible dye releasing coupler is a reactive non-diffusible compound which can be coupled with an oxidized developing agent to release, as a result of the coupling reaction, a dye soluble and diffusible in a processing composition.

A first type of diffusible dye releasing coupler contains a moiety substituted by a residue which is released by a color developing agent, the coupling reaction point of which has been oxidized. The electron conjugation system of the releasable dye may be connected beforehand to the coupler or may be formed by the coupling reaction. The former type is called an "existing type", and in this case the coupler has a spectral absorption similar to that of the dye released. On the other hand, the latter type is called an "instant formation type", and in this case the coupler is fundamentally colorless, or if the coupler is colored, the absorption has no direct connection with the absorption of the dye released and can be considered temporary.

Typical diffusible dye releasing couplers are represented by the following general formulae:

(1) (Cp-1)-L-(Fr) (Existing type)

(2) (Cp-2)-L-(Bl) (Instant formation type)

wherein Cp-1 represents a coupling-reactive structural moiety which is substituted by the (Fr)-L- residue at the coupling position and where at least one of the non-coupling positions has been substituted by a group which contains a hydrophobic group of more than 8 carbon atoms and renders the coupler molecule non-diffusible and Cp-2 represents a coupling reactive moiety which is substituted by a (Bl)-L- residue at the coupling position. When the diffusible dye releasing coupler is used together with a developing agent having no water solubilizing group, the Cp-2 group has at least one water solubilizing group at a non-coupling position.

The (Fr)-L- group and (Bl)-L- group represent groups which are released by an oxidized color developing agent. Fr represents a dye moiety having an absorption in the visible wavelength region and having at least one water solubilizing group. Bl represents a group having a hydrophobic group of more than 8 carbon atoms which renders the coupler molecule non-diffusible.

As the coupling reactive structural moiety utilized in Cp-1 and Cp-2, there can be illustrated many functional groups which are known to undergo oxidative coupling with an aromatic primary amino color developing agent. For example, there are phenols, anilines, cyclic or chain active methylene compounds, and hydrazones. Specific examples of particularly useful reactive structural moieties are the residues induced from a phenol substituted by an acylamino group, where the acyl group preferably has 1 to 4 carbon atoms, 1-hydroxy-2-naphthoic acid amide, N,N-dialkylaniline, where any alkyl moiety preferably has 1 to 6 carbon atoms, 1-aryl-5-pyrazolone (where the aryl moiety preferably has 6 to 10 carbon atoms) of which the 3-position is substituted by an alkyl, aryl, alkoxy, aryloxy, amino, acylamino, ureido, or sulfamide group, pyrazolobenzimidazole, pyrazolotriazole, α-cyanoacetophenone, and α-acylacetanilide.

As bonding group L, whose bond to the coupler moiety is split by the oxidized color developing agent, there can be illustrated an azo group, an azoxy group, a mercury group (—Hg—), an oxy group, a thio group, a dithio group, a triazolyl group, a diacylamino group, where the acyl group preferably has 1 to 4 carbon atoms, an acylsulfonamino group, where the acyl group preferably has 1 to 4 carbon atoms,

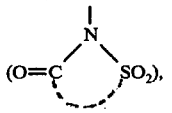

an acyloxy group, where the acyl group preferably has 1 to 4 carbon atoms, a sulfonyloxy group and an alkylidene group preferably having 1 to 6 carbon atoms. Among these groups, an oxy group, a thio group, a dithio group, a diacylamino group, an acyloxy group, etc., which are released as an anion are useful since a large amount of diffusible dye is released. It is preferred that the coupling position of the coupling moiety of a phenol or naphtol be substituted by an oxy group, a thio group, or a diacyloxy group and also it is preferred that the coupling position of a pyrazolone be substituted by an azo group, a thio group, or an acyloxy group and that the coupling group of an acylacetanilide by substituted by an oxy group, a thio group, or a diacylamino group.

Typical examples of the dye moiety represented by Fr are residues induced from azo dye, azomethine dye, indianiline dye, indophenol dye, anthraquinone dye, nitro dye, azine dye, etc.

The hydrophobic group contained in the residue represented by Cp-1 and Bl acts to give an aggregating or associating effect to the coupler molecule in an aqueous medium, and thus makes the coupler molecule non-diffusible in a hydrophilic colloid constituting a photographic material. Preferred examples of the hydrophobic group are a substituted or unsubstituted alkyl group having more than 8 carbon atoms, an alkenyl group, an aralkyl group, an alkaryl group, etc., which groups have at least 8 carbon atoms. For example, there can be illustrated a lauryl group, a stearyl group, an oleyl group, a 3-n-pentadecylphenyl group, and a 2,4-di-t-amylphenoxy group. The hydrophobic residue can be bonded to the fundamental coupling structural moiety directly or through a divalent bond such as an amido bond, ureido bond, ether bond, ester bond, sulfonamido bond, etc., to form Cp-1. Also, the hydrophobic residue can form Bl individually or by bonding to a residue such as an aryl group and a heterocyclic group directly or through a divalent bond as above mentioned.

The water solubilizing group contained in the residue represented by Cp-2 and Fr is an acid group which is substantially dissociated in a processing composition or a precursor group which gives such an acid group as above by hydrolysis. In particular, an acid group having a pKa less than 11 is useful. Examples of such a group are a sulfo group, a sulfuric acid ester group (—O—$SO_3H$), a carboxyl group, a sulfonamide group, a diacylamide group, a cyanosulfonamino group, a phenolic hydroxy group, etc.

When a diffusible dye releasing coupler of the type represented by general formula (1) is reacted with an oxidized developing agent, the bond L is cleaved to form a non-diffusible condensation product of Cp-1 and the developing agent and a soluble dye containing the Fr moiety. The soluble dye diffuses into an image receiving layer to form a dye image there.

On the other hand, when a diffusible dye releasing coupler of the type represented by general formula (2) is reacted with an oxidized developing agent, the bond L is cleaved to form a soluble dye which is the oxidative coupling product of Cp-2 and the developing agent and the non-diffusible released product induced from Bl-L-.

Specific examples of diffusible dye releasing couplers of the type represented by general formula (1) are as follows:

α-[4-(8-Acetamido-3,6-disulfo-1-hydroxy-2-naphthylazo)-phenoxy]-α-pivalyl-4-(N-methyl-N-octadecylsulfamyl)acetanilide. disodium salt.
1-(p-t-Butylphenoxyphenyl)-3-[α-(4-t-butylphenoxy)-propionamido]-4-(2-bromo-4-methylamino-5-sulfo-1-anthra-9,10-quinalyl-azo)-5-pyrazolone
1-Hydroxy-4-{3-[4-N-ethyl-N-β-sulfoethylamino)-2-methylphenylazo]phenylazo}-N-[8-(2,4-di-t-amylphenoxy)butyl]-2-naphthamide.sodium salt Typical examples of diffusible dye releasing couplers of the type represented by general formula (2) are as follows:

α-(4-Methoxybenzoyl)-α-(3-octadecylcarbamylphenylthio)3,5-dicarboxyacetanilide
1-Phenyl-3-(3,5-dicarboxyanilino)-4-(3-octadecylcarbamyl-phenylthio)-5-pyrazolone
1-Phenyl-3-(3,5-disulfobenzoylamino)-5-(2-hydroxy-4-n-pentadecylphenylazo)-5-pyrazolone
1-4-(3,5-Dicarboxybenzamido)phenyl-3-ethoxy-4-(3-octadecylcarbamylthio)-5-pyrazolone
1-Hydroxy-4-(3-octadecylcarbamylphenylthio)-N-ethyl-3′,5′-dicarboxy-2-naphthanilide
1-Hydroxy-4-(n-octadecylsuccinimido)-N-ethyl-3′,5′-dicarboxy-2-naphthanilide Other examples of diffusible dye releasing couplers useful in this invention are described in British Pat. Nos. 840,731, 904,364, and 1,085,631 and U.S. Pat. Nos. 3,476,653, 3,644,498 and 3,419,391.

In the second type of diffusible dye releasing coupler, an intramolecular ring closing reaction with the substituent positioned adjacent the reaction point occurring after a condensation reaction with an oxidized color developing agent is accompanied by the cleavage and release of the dye residue contained in the substituent. In a particularly preferred reaction, after undergoing oxidation coupling with an aromatic primary amino color developing agent at the 4-position of a phenol or aniline, an azine ring is formed with a sulfonamide group containing the dye moiety at the 3-position to release a diffusible dye containing sulfonic acid. Specific examples of this type of compound are as follows:

1-Phenyl-3-ethylcarbamoyl-4-{2-methoxy-4-[N-n-dodecyl-N-(1-hydroxy-4-chloro-3-naphthyl)]sulfamylphenylazo}-5-pyrazolone
2-(β-Octadecylcarbamoylethyl)-4-{2-[4-(2-hydroxy-1-naphthylazo)phenylsulfonamido]anilino}phenol As aromatic primary amino color developing agents used with the diffusible dye releasing couplers, there can be illustrated p-aminophenols, p-phenylenediamines, and derivatives thereof. Specific examples of particularly preferred color developing agents include 2-chloro-4-aminophenol, 2,6-dibromo-4-aminophenol, 4-amino-N,N-diethyl-3-methylaniline, N,N-diethyl-p-phenylenediamine, N-ethyl-β-methanesulfonamidoethyl-3-methyl-4-aminoaniline, 4-amino-N-ethyl-N-(β-sulfobutyl)aniline, 4-amino-N-ethyl-N-(β-hydroxyethyl-)aniline, 4-amino-3-methyl-N-ethyl-N-(β-hydroxyethyl-)aniline, 4-amino-N-ethyl-N-(β-carboxyethyl)aniline, 4-amino-N,N-bis(β-hydroxyethyl)-3-methylaniline, 3-acetamido-4-amino-N,N-(β-hydroxyethyl)aniline, 4-amino-N-ethyl-N-(2,3-dihydroxypropyl)-3-methylaniline, 4-amino-N,N-diethyl-3-(3-hydroxypropoxy)aniline, 4-amino-N-ethyl-N-(β-hydroxyethyl)-3-methoxyaniline, and the hydrochlorides, sulfates, oxalates, and p-toluenesulfonates of these materials. Furthermore, precursors of these developing agents such as the Schiff bases and phthalic acid imides of these anilines are also profitably used in case of incorporating the same in a photosensitive element.

A negative type silver halide emulsion layer containing the diffusible dye releasing coupler provides a negative diffusion transfer dye image by development. On the other hand, a direct positive type silver halide emulsion layer containing the diffusible dye releasing coupler provides a positive diffusion transfer dye image by development. Examples of preferred direct positive type silver halide emulsions are the internal latent image type silver halide emulsions as described in U.S. Pat. Nos. 2,592,250, 2,588,982, and 3,227,552 and the fogged silver halide emulsions as described in British Pat. Nos. 444,245 and 462,730 and U.S. Pat. Nos. 2,005,837, 2,541,472, and 3,367,778.

Moreover, by processing a layer containing a diffusible dye releasing coupler and physical development nuclei formed adjacent a negative type silver halide emulsion layer with a developer containing a silver halide solvent, a positive diffusion transfer dye image can be also obtained. The reversal dye image forming technique utilizing such a physical development as described in British Pat. No. 904,364 may be used for this purpose.

Furthermore, a positive diffusion transfer dye image can also be obtained using a photosensitive element including a negative type silver halide emulsion layer containing a compound capable of releasing a development inhibitor by reaction with the oxidation product of a developing agent (development inhibitor releasing compound or DIR compound) such as 1-phenyl-5-mercaptotetrazole and a layer containing the diffusible dye releasing coupler and a spontaneously reducible metal salt formed adjacent the silver halide emulsion layer as described in U.S. Pat. Nos. 3,227,551, 3,227,554, and 3,364,022 and German Patent Application No. (OLS) 2,032,711. In the present invention, a combinations of these silver halide emulsions and the dye image providing materials can be used, and the negative dye image system or positive dye image system may be selected according to the end use purpose.

(c) Diffusible Dye Releasing Reducing Agents: In this invention, a dye image providing material of the type releasing a diffusible dye by intramolecular reaction or by reaction with an auxiliary chemical, e.g., NaOH, KOH, $Na_2SO_3$, etc., having a characteristic ion which are present in a liquid processing composition after being oxidized as a result of development can be profitably used in addition to the above mentioned dye developers and diffusible dye releasing couplers. In this type of dye image formation, it is preferred that the dye image providing material be oxidized by an auxiliary developing agent such as hydroquinones and 3-pyrazolidones. The oxidized dye image providing material releases a diffusible dye by the action of auxiliary chemicals such as hydroxyl ions and sulfurous acid ions present in the processing composition or the photosensitive element. Examples of this type of dye image providing material are described in U.S. Pat. Nos. 3,585,026 and 3,698,897 and German Patent Application No. (OLS) 2,242,762. Other useful diffusible dye releasing reducing agents are disclosed in U.S. Pat. Nos. 3,958,995 and 3,954,476.

The dye image providing materials used in this invention can be dispersed in a hydrophilic colloid by various means according to the kind of materials involved. For example, a diffusible dye releasing coupler having a dissociable group such as a sulfo group or a carboxyl group may be dispersed in an aqueous solution of a hydrophilic colloid as a solution in water or an alkaline aqueous solution. If the diffusible dye providing material is hardly soluble in water and soluble in an organic solvent, the material is added to an aqueous solution of a hydrophilic colloid as a solution thereof in the organic solvent followed by stirring to disperse it as fine droplets. As suitable solvents used for the purpose, there can be illustrated ethyl acetate, tetrahydrofuran, methyl ethyl ketone, cyclohexanone, $\beta$-butoxy-$\beta$-ethoxyethyl acetate, dimethylformamide, dimethylsulfoxide, 2-methoxyethanol, tri-n-butyl phthalate, etc.

It is preferred that any dye image providing material in accordance with the present invention be used in an amount of about 0.3 to about 3, even more preferably 0.5 to 1.5 g/m$^2$, dry basis.

When the dispersion solvent has a comparatively low vapor pressure, the solvent may be removed from the photographic layers upon drying or may be evaporated off before coating in the manner as described in U.S. Pat. Nos. 2,322,027 and 2,801,171. Furthermore, when the solvent is soluble in water, the solvent may be removed from the photographic layers by water washing in the manner as described in U.S. Pat. Nos. 2,949,360 and 3,396,027. To stabilize the dispersion of the dye-providing materials and accelerate dye image forming, it is profitable to incorporate a solvent which is substantially insoluble in water and has a boiling point of higher than 200° C. at normal pressure in the photosensitive sheet or element together with diffusible dye providing materials. As high boiling point solvents suitably used for this purpose, there are an aliphatic ester such as the triglyceride of a higher fatty acid, di-octyl adipate, etc.; a phthalic acid ester such as di-n-butyl phthalate, etc.; a phosphoric acid ester such as tri-o-cresyl phosphate, tri-n-hexyl phosphate, etc.; an amide such as N,N-diethyl laurylamide, etc.; and a hydroxy compound such as 2,4-di-n-amylphenol. Furthermore, to stabilize the dispersion of the dye image providing material and accelerate dye image forming, it is profitable to incorporate a hydrophilic polymer in the photosensitive sheet or element together with the dye image providing materials. As hydrophilic polymers suitably used for this purpose, there can be illustrated shellac, a phenol-formaldehyde condensate, poly-n-butyl acrylate, a copolymer of n-butyl acrylate and acrylic acid, and a copolymer of n-butyl acrylate, styrene, and methacrylamide. The polymer may be dispersed in an aqueous solution of a hydrophilic colloid as a solution thereof in an organic solvent together with the dye image providing material or a hydrosol of the polymer prepared by emulsion polymerization, etc., may be added to a hydrophilic colloid dispersion of the dye image providing material.

The dye image providing material can be effectively dispersed generally under a high shearing force. For example, a high speed rotary mixer, a colloid mill, a high pressure milk homogenizer, a high pressure homogenizer as described in British Pat. No. 1,304,206, and an ultrasonic wave emulsifier can be advantageously used for this purpose. The dispersion of the dye image providing materials can be greatly promoted using a surface active agent as an emulsification aid. Examples of surface active agent profitably used for the dispersion of the dye image providing materials in this invention are sodium triisopropylnaphthalenesulfonate, sodium dinonylnaphthalenesulfonate, sodium p-dodecylbenzenesulfonate, sodium dioctylsulfosuccinate, sodium cetylsulfate, and the anionic surface active agents as described in Japanese Patent Publication No. 4,293/64. Also, the use of a higher fatty acid ester of anhydrohexitol together with these anionic surface active agents gives a particularly excellent emulsification effect as described in U.S. Pat. No. 3,676,141.

The silver halide emulsion used in this invention is a colloidal dispersion of silver chloride, silver bromide, silver chlorobromide, silver iodobromide, silver chloroiodobromide or a mixture thereof. The halogen composition is properly selected according to the purpose of the photographic material and the processing conditions for the photographic material, but a silver iodobromide or silver chloroiodobromide emulsion containing 1 to 10 mol% iodide, less than 30 mol% chloride, balance bromide, is particularly useful. Also, silver halide emulsions having a mean grain size of from about 0.1 micron to about 2 microns are very useful, and according to the end use purpose of the photographic material, it is desirable that the grain size be uniform. The silver halide grains may be of a cubic system, octahedral system, or a mixed crystal system. These silver halide emulsions may be prepared in a conventional manner as described in *P.* Glafkides, *Chemie Photographique,* 2nd Ed., Paragraphs 18–23, published by Paul Montel, Paris in 1957. That is, a soluble silver salt such as silver nitrate is reacted with a water soluble halide such as potassium bromide in the presence of an aqueous solution of a protective colloid such as gelatin, and then crystal growth is caused to proceed in the presence of a silver halide solvent such as excess halide or ammonia. In this case, a precipitation method such as a single jet method, a double jet method or a pAg controlled double jet method may be used. Soluble salts formed can be removed from the silver halide emulsion by cooling to coagulate the emulsion followed by water washing, by dialysis, by the addition of a precipitant such as an anionic polymer or an anionic surface active agent having a sulfo group, a sulfuric acid ester group, or a carboxyl group followed by pH control, or by using an acylated protein such as phthaloyl gelatin as a protective colloid followed by pH control to cause precipitation.

It is preferred that the silver halide emulsions used in this invention be chemically sensitized by a natural sensitizer contained in gelatin, a sulfur sensitizer such as sodium thiosulfate and N,N,N'-trimethylthiourea, etc., a gold sensitizer such as a thiocyanate complex salt or a thiosulfate complex salt of monovalent gold, or a reduction sensitizer such as stannous chloride and hexamethylene tetramine under heating.

In this invention, a silver halide emulsion which forms latent images on the surfaces of the silver halide grains or a silver halide emulsion which forms latent images in the interior of the silver halide grains as described in U.S. Pat. Nos. 2,592,550 and 3,206,313 can be used.

Furthermore, the silver halide emulsion used in this invention may be stabilized by the addition of 4-hydroxy-6-methyl-1,3,3a,7-tetrazaindene, 5-nitroimidazole, 1-phenyl-5-mercaptotetrazole, 8-chloromercury quinone, benzenesulfinic acid, or pyrocatechin. Other additives such as a cadmium salt, a mercury salt, and a complex salt of a platinum group metal such as a chlorocomplex salt of palladium are also useful for the stabilization of the silver halide emulsions. Still further, the silver halide emulsion used in this invention may further contain a sensitizing compound such as a polyethylene oxide compound.

If desired, the silver halide emulsion used in this invention may have its color sensitivity enlarged by a spectral sensitizing dye. Examples of useful spectral sensitizers are cyanines, merocyanines, holopolar cyanines, styryls, hemicyanines, oxanoles, hemioxanoles, etc. Specific examples of such spectral sensitizers are described in P. Glafkides, *Chimie Photographique,* Paragraphs 35–41 and F. M. Hamer, The *Cyanine Dyes and Related Compounds,* published by Interscience. In particular, cyanines where the nitrogen atom of the nucleus has been substituted with an aliphatic group having a hydroxyl group, a carboxyl group, or a sulfo group are useful, as are described in, for example, U.S. Pat. Nos. 2,503,766, 3,459,553 and 3,177,210.

Processing composition permeable layers such as silver halide emulsion layers, layers containing dye image providing materials, and auxiliary layers, e.g., a protective layer or interlayer, as are used in this invention contain a hydrophilic polymer as a binder. Examples of the hydrophilic polymers suitably used for this purpose are gelatin, casein, gelatin modified by an acylating agent, etc., gelatin having grafted thereto a vinyl polymer, a protein such as albumin, etc., a cellulose derivative such as hydroxyethyl cellulose, methyl cellulose, carboxymethyl cellulose, etc., partially hydrolyzed polyvinyl alcohol, partially hydrolyzed polyvinyl acetate, a polymeric electrolyte such as polyvinyl pyrrolidone, polyacrylamide, etc., polyacrylic acid, partially hydrolyzed polyacrylamide, an anionic synthetic polymer such as a copolymer of vinyl methyl ether and maleic acid, etc., and an ampholytic synthetic polymer such as a copolymer of N-vinylimidazole, acrylic acid and acrylamide and polyacrylamide treated by a Hofman reaction. These hydrophilic polymers may be used individually or as a mixture of them. Furthermore, a layer of the hydrophilic polymer may contain a latex like dispersion of a polymer of a hydrophobic monomer such as an alkyl acrylate, alkyl methacrylate, etc.

These polymers, in particular, hydrophilic polymers having a functional group such as an amino group, a hydroxyl group, or a carboxyl group, can be insolubilyzed by various cross-linking agents without losing the permeability to processing compositions. Examples of particularly preferred cross-linking agents used for this purpose are aldehyde compounds such as formaldehyde, glyoxal and glutaraldehyde, mucochloric acid, oligomers or acrolein, etc., aziridine compounds such as triethylene phosphamide as shown in Japanese Patent Publication 8,790/62; the epoxy compounds such as 1,4-bis(2',3'-epoxypropoxy)-diethyl ester as described in Japanese Patent Publication No. 7,133/59; the active halogen compounds such as 2-hydroxy-1,6-dichloro-s-triazine.sodium salt as described in U.S. Pat. No. 3,325,287; the active olefin compounds such as hexahydro-1,3,5-triacryl-s-triazine; methylol compounds such as N-polymethylolurea and hexamethylolmelamine; dialdehyde starch; and the polymeric materials such as 3-hydroxyl-5-chloro-s-triazinilated gelatin as described in U.S. Pat. No. 3,362,827. Moreover, these hydrophilic polymers layers may further contain a cross-linking reaction accelerator such as a carbonate and resorcin in addition to the cross-linking agent.

The photographic layers used in this invention may be formed by various coating methods such as dip coating, roller coating, air knife coating, bead coating, as described in U.S. Pat. No. 2,681,294, or curtain coating as described in U.S. Pat. Nos. 3,508,947 and 3,513,017. In particular, in multilayer color photographic materials, it is advantageous to simultaneously coat plural photographic layers using the multislit hoppers as described in U.S. Pat. Nos. 2,761,417, 2,761,418, 2,761,419, and 2,761,791.

The facilitate the coating of photographic layers used in this invention, it is profitable to incorporate various surface active agents in the coating compositions as a coating aid. Examples of useful coating aids are nonionic surface active agents such as saponin, an ethoxyethylene addition product of p-nonylphenol, an alkyl ether of sucrose, and a monoalkyl ether of glycerol; anionic surface active agents such as sodium dodecyl sulfate, sodium p-dodecylbenzenesulfonate and sodium dioctyl sulfosuccinate, etc.; and amphoteric surface active agents such as a carboxymethyldimethyllauryl ammonium.hydroxide internal salt "Deriphat 151 ($R\text{-}CH_2NHCH_2CH_2COONa$, R: $C_{12}$ alkyl)", and the betaine compounds as described in U.S. Pat. No. 3,441,413, British Pat. No. 1,159,825, and Japanese Pat. Publication No. 21,985/71.

The coating compositions for the photographic layers used in this invention may further contain various viscosity improvers to further facilitate coating. For example, there are materials capable of increasing the viscosity of coating compositions by their inherent viscosity, such as high molecular weight polyacrylamide, as well as anionic polymers having a viscosity increasing effect due to their coaction with a binder polymer in coating compositions, such as the acrylic polymers shown in U.S. Pat. No. 3,655,407 and cellulose sulfuric acid ester, and poly-p-sulfostyrene.potassium salt.

In the photographic element used in this invention, a silver halide emulsion layer has associated therewith a dye image providing material. Combinations of suitable color sensitivities of silver halide emulsions and suitable spectral absorptions of dye images are properly selected according to the desired color reproduction. In natural color reproduction by a subtractive color process, a photosensitive element having at least two combinations, each comprising a silver halide emulsion possessing a selective spectral absorption at a wavelength region and a dye image providing compound possessing a selective spectral absorption in the same wavelength region, are used. In particular, a photosensitive element having a combination of a blue-sensitive silver halide emulsion and a yellow dye image providing compound, a combination of a green-sensitive silver halide emulsion and a magenta dye image providing compound, and a combination of a red-sensitive silver halide emulsion and a cyan dye image forming material is useful. These combination units of the silver halide emulsions and dye image providing materials may be incorporated in layers superposed in face-to-face relationship or the components of these combination units may be incorporated in a layer as a mixture of fine particles thereof. In a preferred embodiment of the multilayer photosensitive material, a blue-sensitive silver halide emulsion layer, a green-sensitive silver halide emulsion layer, and a red-sensitive silver halide emulsion layer are formed in this order from the exposure side, and, in particular, when the silver halide emulsions used are highly sensitive silver halide emulsions containing iodide, a yellow filter layer may be disposed between the blue-sensitive silver halide emulsion layer and the green-sensitive silver halide emulsion layer.

The yellow filter layer used for this purpose contains a dispersion of yellow colloidal silver, a dispersion of an oil soluble yellow dye, an acid dye mordanted by a basic polymer, or a basic dye mordanted by an acid polymer.

It is further advantageous that the silver halide emulsion layers be isolated from each other by an interlayer. The interlayer acts to prevent an undesirable coaction between different color sensitized silver halide emulsion layers. The interlayer is usually composed of a hydrophilic polymer such as gelatin, polyacrylamide, and partially hydrolyzed polyvinyl acetate; a polymer having fine porosity formed by a latex composed of the hydrophilic polymer and the hydrophobic polymer as described in U.S. Pat. No. 3,625,685; or a polymer which gradually increases in hydrophilicity in the presence of a processing composition, such as calcium alginate as is described in U.S. Pat. No. 3,384,483. The interlayer may further contain an agent for preventing coaction between silver halide emulsion layers, which is selected according to the types of the dye image providing materials and the processing composition employed. For example, when a dye image providing material of the type that a diffusible dye is released by reaction with an oxidation product of a color developing agent is used, non-diffusible couplers which can be fixed by the reaction with the oxidation product or a reducing agent, such as a non-diffusible hydroquinone derivative, are effective to prevent the occurrence of an undesirable interchange of the oxidation product of a color developing agent between the silver halide emulsion units. Furthermore, it is desirable, to obtain excellent color reproduction, that in performing image reversal by dissolution physical development the interlayer contain physical development nuclei, such as colloidal metallic silver, in addition to the aforementioned materials and also in performing image reversal using a development inhibitor releasing compound, the interlayer contains fine granular silver halide grains of low sensitivity.

The processing composition used in this invention is a liquid composition which contains the processing compositions necessary for developing exposed silver halide emulsions and forming a diffusible dye image. The main solvent is water but it can contain, as desired or necessary, a hydrophilic solvent such as methanol or methyl cellosolve. The processing composition further contains alkali in an amount sufficient to maintain the necessary pH to effect development of the silver halide emulsion(s) and to neutralize acid formed during development and dye image formation.

Examples of the alkali useful for this purpose are sodium hydroxide, potassium hydroxide, a dispersion of calcium hydroxide, tetramethylammonium hydroxide, sodium carbonate, trisodium phosphate, diethylamine, etc., and it is preferred that the processing composition have a pH higher than about 12 at room temperature. It is even more preferred that the processing composition contain a hydrophilic polymer such as polyvinyl alcohol, hydroxyethyl cellulose, or sodium carboxymethyl cellulose. Such a polymer gives a viscosity of higher than 1 poise, preferably of about 1,000 poises, at room temperature to the processing composition and facilitates uniform spreading of the processing composition at development as well as forming a non-fluid film when the aqueous medium in the processing composition diffuses to the photosensitive element and the image receiving element during processing, thereby assisting to unitize the film units after processing. The polymer film can also be utilized, after substantially completing the formation of diffusion transfer dye images, to prevent coloring matter from further transferring into the image receiving element to discolor the dye images formed.

Moreover, the processing composition may further contain a light absorbing material such as carbon black to prevent the silver halide emulsions from being fogged by surrounding light during processing and also a desensitizing agent as is described in U.S. Pat. No. 3,579,333. Still further, it is often advantageous that the processing composition contain processing components specific to the dye image providing material used. For example, when the dye image providing material is a dye developer, the processing components specific thereto are an auxiliary developing agent such as p-aminophenol, 4′-methylphenyl hydroquinone, 1-phenyl-3-pyrazolidone, etc.; an onium development accelerator such as N-benzyl-α-picolinium bromide; and an anti-fogging such as benzotriazole, and when the dye image providing material is a diffusible dye releasing coupler, the processing components specific thereto are a color developing agent such as an aromatic primary amino color developing agent; an antioxidant such as a sulfite and ascorbic acid; an anti-foggant such as a halide or 5-nitrobenzimidazole; and a silver halide solvent such as a thiosulfate or uracil.

Furthermore, if a white reflecting agent such as titanium dioxide is incorporated in the processing composition, a positive image formed can be observed through a transparent support of an image receiving material, such as a polyethylene terephthalate film or a triacetyl cellulose film, without separating the image receiving material from the negative photosensitive material after spreading the processing composition for development and diffusion transfer to the image. In this case, the proportion of the white reflecting agent contained in the processing composition is preferably about 20 to 60%, although there is no particular restriction on the proportion thereof. When such a white reflecting agent is not used, the positive image formed can be observed by exposing a photographic unit comprising a negative photosensitive element and an image receiving element, subjecting the photographic element to a diffusion transfer, and then separating the negative material. Examples of other materials as can be used as white reflecting agents are disclosed in U.S. Pat. Nos. 3,594,164, 3,594,165, and 3,689,262.

It is advantageous that the processing composition be placed in a rupturable container. Such a container comprises a liquid and air impervious sheet material folded and sealed to one another at the end margins to form a cavity in which the processing composition is retained. When the film unit passes through pressing means, the container is ruptured at a predetermined position by the internal pressure applied to the processing composition to release the contents. Materials for forming the container include, for example, a laminate of a polyethylene terephthalate film, a polyvinyl alcohol film and a polyethylene film or a laminate of a lead foil and a film of a copolymer of vinyl chloride and vinyl acetate. The container is fixedly positioned along the leading edge of the film unit in such a manner that the processing composition contained therein is spread over the surface of the photosensitive element in one direction. Preferred examples of useful containers are described in U.S. Pat. Nos. 2,543,181, 2,643,886, 2,653,732, 2,723,051, 3,056,491, 3,056,492, 3,152,515, and 3,173,580.

It is most preferred in accordance with the present invention that any processing composition used have a viscosity of from about $1 \times 10^{-4}$ to about $1 \times 10^{-5}$ cp; other processing compositions can be used, of course, but this viscosity range gives best results, in general.

Various dyeable polymers can be used for the image receiving layer. For example, a basic polymer or a cationic polymer generally known for this purpose (for example, the polymers described in Japanese Patent Publication No. 26, 135/63) is preferably used. In particular, dyeable polymers having the following structures are preferred, although the dyeable polymers used in this invention are not limited to them.

1.

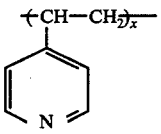

2.

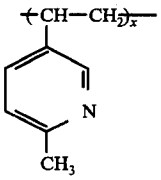

3.

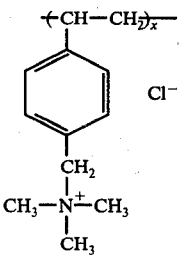

4.

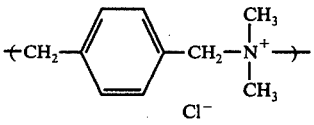

-continued

5.

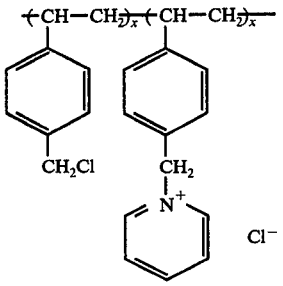

6.

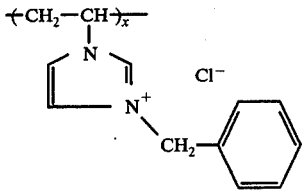

7.

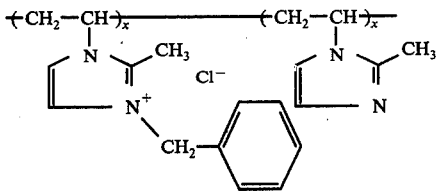

8.

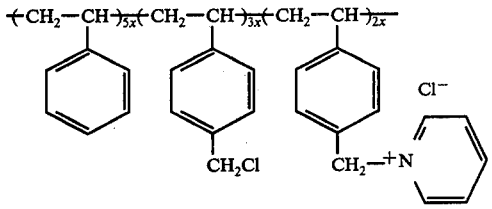

9.

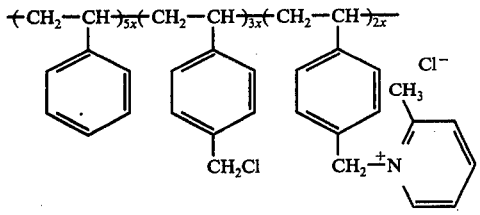

10.

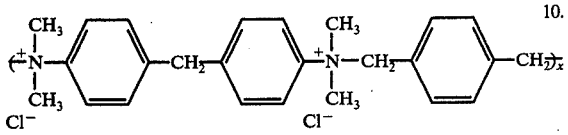

11.

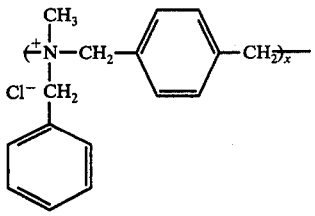

wherein $x$ represents the polymerization degree and is in the range of about $10^2$ to about $5 \times 10^3$, preferably $5 \times 10^2$ to $2 \times 10^3$.

While a dyeable polymer may form an image receiving layer by itself alone, it may also form it together with other natural or synthetic hydrophilic polymers such as gelatin, polyvinyl alcohol, polyvinyl pyrrolidone, etc. Further, two kinds of dyeable polymers may be used together. The thickness of the image receiving layer is desirably selected according to the end use purpose, but is usually in a range of 3 to 60 microns, preferably 5 to 20 microns, although the thickness of not restricted to the value.

Supports as are conventionally used for photographic materials can also be used in this invention. For example, there can be illustrated a baryta coated paper; a paper laminated with polyethylene, etc.; a cellulose organic ester sheet such as a diacetyl cellulose sheet, a triacetyl cellulose sheet, a cellulose acetate butyrate sheet, etc.; cellulose inorganic acid ester sheet such as a cellulose nitrate sheet; a polyvinyl ester sheet such as a polyvinyl acetate sheet, etc.; a polyester sheet such as a polyethylene terephthalate sheet; a polyvinyl acetal sheet; and a polyalkylene sheet such as polystyrene sheet, a polypropylene sheet, a polyethylene sheet, etc.

For commercial products, it is generally preferred that any silver halide layer used in an element in accordance with the present invention have a thickness of from about 1 to about 7$\mu$, more preferably 2 to 5$\mu$, any white reflecting layer have a thickness of from about 5 to about 5$\mu$, more preferably 8 to 12$\mu$, and any light-shielding layer (opacifying layer containing, for example, carbon black) have a thickness of from about 1.5 to about 5$\mu$, more preferably 2 to 4$\mu$, and the light-shielding layer be superposed on a white reflecting layer.

The invention will now be further illustrated by the following detailed Examples but is not to be limited thereto.

EXAMPLE 1

Film A and Film B were prepared in the following manner.

Film A

Film A was prepared by uniformly coating on a gelatin subcoated polyethylene terephthalate support a polyacrylic acid solution having the following composition as a neutralizing acid polymer layer at a coverage of 150 g/m$^2$ followed by drying in air at 100° C., coating on the neutralizing layer a timing layer as shown in Table 1, and then coating thereon a diffusible dye receiving layer (mordant layer) as the uppermost layer as shown below.

| Composition of the polyacrylic acid solution | | |
|---|---|---|
| Aqueous solution of 20% polyacrylic acid (molecular weight of about 5 × 10$^5$) | 6 | kg |
| Aqueous solution of 5% sodium dodecylbenzenesulfonate | 150 | ml |
| Polyethylene glycol (mean molecular weight of 400) | 50 | g |
| Water | 3.75 | l |

The above dyeable layer was formed by coating a polymer composition at a coverage of 6 g/m$^2$ of polyvinyl alcohol (molecular weight of about 7 × 10$^4$), 2,4 g/m$^2$ of poly-4-vinylpyridine (molecular weight about 1.2 × 10$^5$), 0.6 g/m$^2$ of poly(2-methacryloxyethyltriethyl ammonium ethylsulfate (molecular weight about 2 × 10$^5$)), and 0.08 g/m$^2$ of trimethylolmelamine.

Films A-1 to A-9 were prepared in the same way as above according to the kinds of polymers used for the timing layer and each of the films was superposed in Film B. The coating methods of preparing these films are also shown in Table 1.

Film B

Film B was prepared by coating on a gelatin subcoated cellulose triacetate support a silver iodobromide emulsion at a coverage of 0.8 g/m$^2$ of silver, 7 g/m$^2$ of gelatin, 0.65 g/m$^2$ of dibutyl phthalate, 0.92 g/m$^2$ of 1-hydroxy-N-n-dodecyl-2-naphthamide, and 0.39 g/m$^2$ of 1-hydroxy-N-$\gamma$-(2',4'-di-t-amylphenoxy)-propyl-2-naphthamide and then coating thereon a protective layer at a coverage of 0.6 g/m$^2$ of gelatin.

An alkaline processing composition having the following formulation was then spread between Film A and Film B at a thickness of 100 microns. After a definite period of time (as shown in Table 2), Film A was separated from Film B and the pH at the surface of Film B was measured by means of a small electrode for pH measurement.

The formulation of the alkaline processing composition used above was as follows:

| | | |
|---|---|---|
| Sodium hydroxide | 35 | g |
| Hydroxyethyl cellulose | 30 | g |
| 3-Methyl-4-amino-N-ethyl-N-$\beta$-hydroxyethyl)aniline sulfate | 35 | g |
| Sodium thiosulfate | 8 | g |
| Ascorbic acid | 0.2 | g |
| 5-Nitrobenzimidazole nitrate | 0.2 | g |
| Water | 1 | l |

*Viscosity: 3 × 10$^{-4}$ cp; hereafter the same

TABLE 1

| Test Number | Polymer for Neutralization Controlling Agent | Solvent for Coating | Dry Thickness |
|---|---|---|---|
| A-1 (this invention) | Vinyl acetate-N-vinylpyrrolidone copolymer (83:17 mole ratio; hereafter mole ratio is omitted) | Ethanol-water (4:1 in vol. ratio) | 7.7 $\mu$ |
| A-2 (") | " (88:12) | " | 6.5 $\mu$ |
| A-3 (") | Vinyl acetate-2-hydroxyethylmethacrylate copolymer (9:1) | " | 7.2 $\mu$ |
| A-4 (") | Vinyl acetate-2-methoxyethyl methacrylate copolymer (9:1) | " | 6.6 $\mu$ |
| A-5 (") | Vinyl acetate-N,N-diethylacrylamide copolymer (44:56) | Ethanol | 5.2 $\mu$ |
| A-6 (") | Vinyl acetate-acrylamide copolymer (7:3) | " | 5.8 $\mu$ |
| A-7 (") | Vinyl acetate-2-methyl-N-vinylimidazole copolymer (95:5) | Acetone | 5.3 $\mu$ |
| A-8 (") | Vinyl acetate-1-vinyl-3,5-dimethyl-1,2,4-triazole copolymer (95:5) | " | 2.8 $\mu$ |
| A-9 (comparison) | Polyvinyl alcohol* | water | 10 $\mu$ |

*The polymer shown in U.S. Pat. 3,362,819.

The molecular weight of the polymers was as follows:

| Test No. | Molecular Weight |
|---|---|
| A-1 | 2 × 10$^4$ |
| A-2 | 3 × 10$^4$ |
| A-3 | 5 × 10$^4$ |
| A-4 | 6 × 10$^4$ |
| A-5 | 4 × 10$^4$ |
| A-6 | 1 × 10$^4$ |
| A-7 | 2 × 10$^4$ |
| A-8 | 3 × 10$^4$ |
| A-9 | 7 × 10$^4$ |

The change of the surface pH of Film B with the passage of time was as shown in Table 2.

TABLE 2

| Sample No. of Film A | After 1 min | 5 min | 10 min | 15 min | 20 min | 30 min | 45 min | 60 min |
|---|---|---|---|---|---|---|---|---|
| A-1 | 12.1 | 11.9 | 8.4 | 5.1 | — | — | — | — |
| A-2 | 12.5 | 12.5 | 12.5 | 12.5 | 12.5 | 12.0 | 10.7 | 8.4 |
| A-3 | 12.3 | 12.0 | 10.7 | 7.2 | 6.3 | — | — | — |
| A-4 | 12.5 | 12.4 | 11.3 | 9.2 | 8.8 | 7.5 | — | — |
| A-5 | 12.1 | 12.0 | 8.0 | 5.9 | 5.4 | — | — | — |
| A-6 | 12.1 | 11.9 | 11.3 | 11.0 | 7.5 | 7.0 | 6.5 | — |
| A-7 | 12.3 | 12.3 | 12.2 | 12.2 | 7.7 | 7.1 | — | — |
| A-8 | 12.5 | 12.3 | 12.3 | 12.3 | 6.7 | — | — | — |
| A-9 | 12.4 | 11.5 | 10.1 | 8.1 | 6.5 | — | — | — |

As is clear from the results shown in Table 2, when the timing layer of this invention was used, the pH was maintained above 12 at the beginning of spreading the developer to effectively perform the development, but thereafter the pH was quickly reduced, i.e., the results show ideal behavior. On the other hand, in the comparison sample, the pH was quickly reduced from the outset, which causes an inhibition of development.

EXAMPLE 2

A multilayer color photographic element was prepared by coating, in succession, the following layers on the surface of a transparent cellulose acetate film support 100 microns thick.

1. Diffusible Cyan Dye Providing Coupler Containing Layer

A gelatin layer containing a coupler, 1-hydroxy-4-hexadycyloxy-N-ethyl-3',5'-dicarboxy-2-naphthanilide, having the formula:

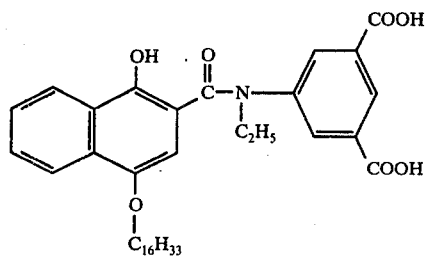

and colloidal silver at a coverage of $1.70 \times 10^{-3}$ mol/m$^2$ of the coupler, 0.77 g/m$^2$ of gelatin, and $3.62 \times 10^{-2}$ g/m$^2$ of silver.

2. Interlayer

A layer containing a non-diffusible cyan coupler, 1-hydroxy-2-dodecylnaphthamide, at a coverage of $3.82 \times 10^{-4}$ mol/m$^2$, a non-diffusible cyan coupler, 1-hydroxy-N-[(2,4-di-tertiary-amylphenoxy)propyl]-2-naphthamide, at a coverage of $1.20 \times 10^{-4}$ mol/m$^2$, 2,5-di-tert-octylhydroquinone at a coverage of $7.0 \times 10^{-4}$ mol/m$^2$, di-n-butylphthalate at a coverage of 0.51 g/m$^2$, and gelatin at a coverage of 0.9 g/m$^2$.

3. Blue-Sensitive Gelatino Silver Iodobromide Emulsion Layer

A blue-sensitive gelatino silver iodobromide emulsion layer containing a non-diffusible cyan coupler, 1-hydroxy-2-dodecylnaphthamide, at a coverage of 0.37 mol/m$^2$, a non-diffusible cyan coupler, 1-hydroxy-N-[(2,4-di-tert-amylphenoxy)propyl]-2-naphthamide, at a coverage of 0.12 mol/m$^2$, 2,5-di-tert-octylhydroquinone at a coverage of $2.35 \times 10^{-4}$ mol/m$^2$, di-n-butyl phthalate at a coverage of 1.12 g/m$^2$, silver at a coverage of $1.13 \times 10^{-2}$ mol/m$^2$, a green-sensitive dye, anhydro-3,3'-di-(γ-sulfopropyl)-5,5'-diphenyl-9-ethyl oxacarbocyanine hydroxide sodium salt in an amount of $1 \times 10^{-4}$ mol per mol of silver, and gelatin at a coverage of 1.22 g.m$^2$, the silver halide containing 4.0 mol% iodide and having a mean grain size of 0.8 micron.

4. Protective Layer

An uppermost protective layer containing gelatin at a coverage of 0.63 g/m$^2$.

The multilayer photosensitive element was then exposed to a 1 kw tungsten lamp of a color temperature of 2854° K. at 20 CMS (1/20 sec).

A processing container containing a processing composition having the following formulation was used. The processing container was prepared by folding a laminate of polyethylene, aluminum, cellophane, and polyethylene and then heat sealing to form a cavity retaining the processing composition. The container contained 1.4 ml of the processing composition and could be easily ruptured by the action of a pressing means to release the processing composition.

| | | |
|---|---|---|
| Water | 100 | ml |
| Ascorbic acid | 20 | ml |
| 4-Amino-3-methyl-N-ethyl-N-(β-hydroxyethyl)aniline.sulfate (monohydrate) | 2.8 | g |
| Sodium hydroxide | 3.5 | g |
| Sodium thiosulfate | 0.8 | g |
| 6-Nitrobenzimidazole nitrate | 1.5 | mg |
| Hydroxyethyl cellulose | 3.0 | g |
| Titanium dioxide | 25.0 | g |

The preparation of the processing composition and the introduction of it into the processing container were performed under a Freon gas atmosphere.

The above multilayer photosensitive element and the image receiving element as shown below were cut into a size 10 cm × 8 cm and brought into a superposed relationship so that the light-sensitive layer of the former faced the image receiving layer of the latter and the processing composition in the container was spread between them at a coverage of 1.0 ml per 100 cm$^2$. Then, the reflection densities of the dye images transferred by diffusion to the image receiving element were measured using a red filter and a blue filter (interference filters each having a spectral transmission maximum at 645 nm or 436 nm, made by Nippon Shinku Kogahu K.K., respectively). Density measurements were carried out using a P-type densitometer made by Fuji Photo Film Co., Ltd.

Image Receiving Element A

The image receiving element was prepared by coating, in succession, the following layers on a transparent polyethylene terephthalate film 100 microns thick.

1. Neutralizing Layer

The following coating composition was coated in a dry thickness of 15 microns.

| | |
|---|---|
| Aqueous solution of 20% polyacrylic acid (molecular weight of about $5 \times 10^5$) | 600 g |
| Aqueous solution of 5% sodium dodecylbenzenesulfonate | 15 ml |
| Polyethylene glycol (mean molecular weight of 400) | 5 g |
| Water | 375 ml |

2. Timing Layer

The following coating composition was coated in a dry thickness of 10 microns.

| | |
|---|---|
| Aqueous solution of 10% polyvinyl alcohol (molecular weight of about $7 \times 10^4$) | 100 g |
| Aqueous solution of 5% sodium dodecylbenzenesulfonate | 3 ml |
| Aqueous solution of 10% trimethylolmelamine | 4 ml |

3. Mordant Layer

The following composition was coated in a dry thickness of 15 microns.

| | | |
|---|---|---|
| Polyvinyl alcohol (molecular weight of about $7 \times 10^4$) | 14 | g |
| Polyvinyl pyridine (molecular weight of about $1.2 \times 10^5$) | 5.6 | g |
| Poly(2-methacryloxyethyl-triethylammoniumethosulfate) (molecular weight of about $2 \times 10^5$) | 1.4 | g |
| Aqueous solution of 10% trimethylolmelamine | 7 | ml |
| Mixture of ethanol and water (2.5:1 volume mixing ratio) | 300 | ml |

Image Receiving Element B

This image receiving element was prepared in the same manner as in the case of preparing image receiving element A except that the timing layer was formed by coating a copolymer of vinyl acetate and N-vinylpyrrolidone (83:17 mol ratio; molecular weight of about $2 \times 10^5$) in a dry thickness of 7 microns.

The minimum transferred image density (exposed areas) and the maximum transferred image density (unexposed areas) of the image in the fresh state and 1 day after development are shown in Table 3.

TABLE 3

| Image Receiving Element | Maximum Density | | | | Minimum Density | | | |
|---|---|---|---|---|---|---|---|---|
| | Fresh State | | 1 Day | | Fresh State | | 1 Day | |
| | red | blue | red | blue | red | blue | red | blue |
| Element A (comparison) | 2.17 | 0.62 | 0.59 | 0.57 | 0.33 | 0.31 | 0.27 | 0.35 |
| Element B | 1.97 | 0.64 | 0.85 | 0.45 | 0.20 | 0.24 | 0.18 | 0.25 |

In the above table, the change of red density in the maximum density column shows the fading of the cyan image and the change of the blue density in the minimum density column includes the increase in yellow stain (caused mainly by the presence of an oxidation product of a color developing agent). The results in the above table show that in the case of using the timing layer containing the copolymer of this invention (image receiving element B), the stability of the cyan dye image formed was improved and the formation of yellow stain could be reduced in the fresh state as well as one day after development. Furthermore, the fact that in the case of using image receiving element B the red density at the exposed areas (the minimum density column) was lower in the fresh state indicates that a good reversal image can be obtained as the development proceeded sufficiently.

EXAMPLE 3

A multilayer photosensitive element was prepared by coating, in succession, the following layers on a sub-coated transparent cellulose acetate film base 100 microns thick.

1. Diffusible Magenta Dye Image Providing Coupler Containing Layer

A gelatin layer containing a coupler, 1-(2-methylphenyl)-3-(3,5-dicarboxyanilino)-4-(3-octadecylcarbamylphenylthio)-5-pyrazolone, having the following formula at a coverage of $1.8 \times 10^{-3}$ mol/m$^2$, colloidal silver at a coverage of $3.62 \times 10^{-2}$ g/m$^2$, and gelatin at a coverage of 2 g/m$^2$.

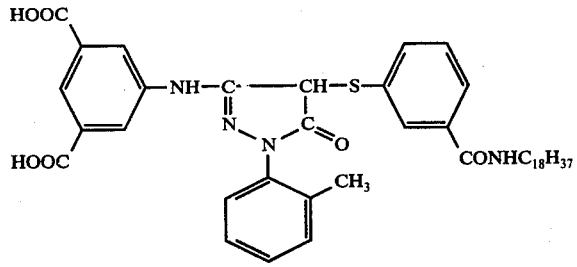

2. Interlayer

Same as the interlayer in Example 2.

3. Green-Sensitive Gelatino Silver Iodobromide Emulsion Layer

Same as the gelatino silver iodobromide emulsion layer as used in Example 2, except the emulsion was rendered green-sensitive by adding thereto an effective amount of anhydro-3,3'-di(δ-sulfopropyl)-5,5'-diphenyl-9-ethyl oxacarbocyanine hydroxide sodium salt.

4. Protective Layer

Same as the protective layer in Example 2.

Image receiving elements to be used in combination with the above mentioned multilayer photosensitive element were prepared in the following manner.

Image Receiving Element A

The image receiving element was prepared by coating, in succession, the following layers on a sub-coated transparent polyethylene terephthalate film 100 microns thick.

1. Neutralizing Layer (also for scavenging primary aromatic amino color developing agent)

The following composition was coated in a dry thickness of 15 microns.

| | |
|---|---|
| Aqueous solution of 20% polyacrylic acid (molecular weight: about $5 \times 10^5$) | 200 g |
| Aqueous solution of 5% sodium dodecylbenzenesulfonate | 3 ml |
| Polyethylene glycol (mean molecular weight of 400) | 2 g |
| Formaldehyde-bisulfite addition product | 30 g |
| Water | 100 ml |

2. Timing Layer

An 8% solution in a 7:3 volume mixture of ethanol and water of the 40% acetalated product of polyvinyl alcohol and acetaldehyde was coated in a dry thickness of 5 microns.

3. Mordant Layer

Same as the dyeable layer in Example 2.

Image Receiving Element B

The image receiving element was prepared in the same manner as preparing image receiving element A except that a copolymer of vinyl acetate and N-vinyl pyrrolidone (83:17 mol ratio; molecular weight: about $2 \times 10^4$) was coated in a thickness of 7 microns as the timing layer.

Each of image receiving elements A and B was combined with the multilayer photosensitive element prepared above and then the assembly processed as in Example 2. The reflection densities of the dye images transferred to the image receiving elements were measured using a green filter and a blue filter, respectively.

The minumum deisities of the transferred dye images (exposed areas) and the maximum densities of the transferred dye images (unexposed areas) formed in the image receiving elements in the fresh state and 1 month after development thus measured are shown in Table 4.

TABLE 4

| Image Receiving Element | Maximum Density | | | | Minimum Density | | | |
|---|---|---|---|---|---|---|---|---|
| | Fresh State | | One Month | | Fresh State | | One Month | |
| | green | blue | green | blue | green | blue | green | blue |
| Element A | 2.62 | 1.22 | 2.68 | 1.98 | 0.50 | 0.35 | 1.05 | 1.06 |
| Element B | 2.58 | 1.13 | 2.54 | 1.47 | 0.49 | 0.33 | 0.50 | 0.47 |

As is shown in the above table, a difference was scarcely observed between image receiving element A and image receiving element B for the maximum density and the minimum density in the fresh state, but there was observed a large difference for the minimum density 1 month after development, which shows that increased stain was greatly reduced using image receiving element B having the timing layer of this invention.

EXAMPLE 4

By the same procedure as in Example 3, the photosensitive elements were subjected to a fine-line exposure for sharpness testing by X-rays. The results showed that the transfer rate was higher and a transferred image having very high sharpness was obtained with image receiving element B as compared with image receiving element A (for comparison).

While the invention has been described in detail and with reference to specific embodiments thereof, it will be apparent to one skilled in the art that various changes and modifications can be made therein without departing from the spirit and scope thereof.

What is claimed is:

1. A color diffusion transfer photographic material comprising a photosensitive element including at least one silver halide emulsion layer having associated therewith a dye image providing material, an image receiving element for fixing the diffusible dye formed from said dye image providing material to form a dye image, an alkaline processing composition for developing the exposed photosensitive element, neutralizing means to lower the pH of the processing composition, and, if desired, another hydrophilic layer or layers, said neutralizing means including a neutralization rate controlling layer and said neutralization rate controlling layer containing a copolymer of at least one vinyl compound and at least one unsaturated monomer addition polymerizable with the vinyl compound, said copolymer having the recurring structural unit represented by the general formula:

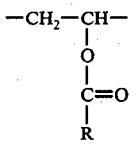

wherein R represents a hydrogen atom of an aliphatic group having 1 to 4 carbon atoms wherein the proportion of the recurring structural unit ranges from 65 to 95 mol % and at least one of the unsaturated monomer(s) addition polymerizable with the vinyl compound is selected from hydroxyalkyl acrylates, hydroxyalkyl methacrylates, vinyl heterocyclic compounds, acrylamides or methacrylamides, said neutralization rate controlling layer being so configured that a support has coated thereon, in order, as essential layers, one of configurations (1) to (4):

(1) an acid polymer layer, the neutralization rate controlling layer, and an image receiving layer;

(2) an acid polymer layer, the neutralization rate controlling layer, and a photosensitive layer or layers;

(3) an acid polymer layer, the neutralization rate controlling layer, an image receiving layer, a white reflecting layer, and a photosensitive layer or layers; or (4) an acid polymer layer, and the neutralization rate controlling layer, the neutralization rate controlling layer being disposed so as to be between the acid polymer layer and the alkaline processing composition when the alkaline processing composition is spread for developing the exposed photosensitive element.

2. The material of claim 1, wherein the aliphatic group R is substituted by a halogen atom, a cyano group, an alkoxy group, an aryl group, a hydroxy group, an acyl group, a sulfo group or an amino group.

3. The material of claim 1, wherein when the number of said unsaturated monomer addition polymerizable with the vinyl compound is 2 or more, the unsaturated monomer in addition to hydroxyalkyl acrylates, hydroxyalkyl methacrylates, vinyl heterocyclic compounds, acryl amides, or methacrylamides is selected from acrylic acids, acrylamides, methacrylic acids, methacrylamides, allyl compounds, vinyl ethers, vinyl esters, vinyl heterocyclic compounds, styrenes, maleic acids, fumaric acids, itaconic acids, olefins, crotonic acids, sorbic acids, vinyl ketones, halogenated olefins, halogenated acrylic acids, unsaturated nitriles, $\alpha$, $\beta$-unsaturated dicarboxylic acids, N-vinylamides or cinnamic acids.

4. The material of claim 1, in which said photographic material comprises a combination of a support having coated thereon, in order, an acid polymer layer, the neutralization rate controlling layer, and an image receiving layer; a support having coated thereon a photosensitive layer or layers; and an alkaline processing composition, said image receiving layer being in a superposed relationship with said photosensitive layer and said processing composition being so configured that the processing composition can be spread between both layers at development.

5. The material of claim 1, in which said photographic material comprises a combination of a support having coated thereon an image receiving layer; a support having coated thereon, in order, an acid polymer layer, the neutralization rate controlling layer, and a photosensitive layer or layers; and an alkaline processing composition, said image receiving layer being in a superposed relationship with said photosensitive layer and said processing composition being so configured that the processing composition can be spread between both layers at development.

6. The material of claim 1, in which said photographic material comprises a combination of a support having coated thereon, in order, an acid polymer layer, the neutralization rate controlling layer, an image receiving layer, a white reflecting layer, and a photosensitive layer or layers; a support formed adjacent said photosensitive layer; and an alkaline processing composition, said processing composition being so configured that the processing composition can be spread between said photosensitive layer and said support adjacent the photosensitive layer.

7. The material of claim 1, in which said color diffusion transfer photographic material comprises a combination of a support having coated thereon, in order, an acid polymer layer and the neutralization rate controlling layer; a support having coated thereon, in order, an image receiving layer, a white reflecting layer, and a photosensitive layer or layers; and an alkaline processing composition, said processing composition being so configured that the processing composition can be spread over the surface of said photosensitive layer.

8. The material of claim 1, in which said dye providing material associated with the silver halide emulsion layer is a dye developer.

9. The material of claim 1, in which said dye image providing material associated with the silver halide emulsion layer is a diffusible dye releasing type coupler.

10. The material of claim 1, in which said dye image providing material associated with the silver halide emulsion layer is a diffusible dye releasing reducing agent.

11. The material of claim 1, wherein said copolymer contained in the neutralization rate controlling layer is a vinyl acetate-N-vinyl pyrrolidone copolymer, a vinyl acetate-2-hydroxyethyl methacrylate copolymer, a vinyl acetate-N,N-diethylacrylamide copolymer, a vinyl acetate-acrylamide copolymer, a vinyl acetate-2-methyl-N-vinylimidazole copolymer, a vinyl acetate-1-vinyl-3,5-dimethyl-1,2,4-triazole copolymer, a vinyl acetate-N-vinyl-2-methylimidazole copolymer or a vinyl acetate-N-vinyl-3,5-dimethyltriazole copolymer.

12. The material of claim 1, wherein the unsaturated monomer addition polymerizable with the vinyl compound is a vinyl heterocyclic compound.

13. The material of claim 12, wherein the vinyl heterocyclic compound comprises a heterocyclic residue which is an unsaturated or saturated nitrogen-, oxygen- or sulfur-containing a 5 to 7 membered ring which can be condensed.

14. The material of claim 12, wherein the vinyl heterocyclic compound is N-vinyloxazolidone, vinylpyridine, vinylpicoline, N-vinylimidazole, N-vinyl-2-methyl-imidazole, N-vinyltriazole, N-vinyl-3,5-dimethyltriazole, N-vinylpyrrolidone, N-vinyl-3,5-dimethylpyrazole, N-vinylcarbazole, vinylthiophene, N-vinylsuccinimide, N-vinylglutarimide, N-vinyladipimide, N-vinylpiperidone, N-vinyl-ε-caprolactam, or N-vinyl-2-pyridone.

15. The material of claim 1, wherein the acrylamides and the methacrylamides are selected from acrylamide, N-substituted acrylamides, methacrylamide and N-substituted acrylamides, where the substituent of the N-substituted acrylamide or methacrylamide is an aliphatic group, an aryl group, an acyl group, or an amino group, or wherein more than one substituent is present and the substituents thereof join with each other to form a nitrogen-containing heterocyclic group having a 6- or 7-membered ring.

16. The material of claim 1, in which said vinyl compound has general formula (IA):

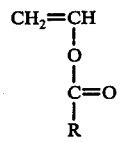

(IA)

wherein R is as defined in claim 1, and wherein said copolymer comprises a plurality of compounds shown by general formula (IA) plus one unsaturated monomer addition polymerizable with the vinyl compound.

17. The material of claim 1, in which said vinyl compound has general formula (IA):

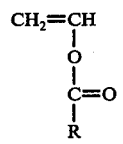

(IA)

wherein R is as defined in claim 1, wherein the copolymer comprises one vinyl monomer of general formula (IA) plus a plurality of unsaturated monomers at least one of which is the unsaturated monomer addition polymerization with the vinyl compound of general formula (IA).

18. The material of claim 1, in which said vinyl compound has general formula (IA):

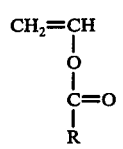

(IA)

wherein R is as defined in claim 1, and wherein the copolymer comprises a plurality of vinyl monomers of general formula (IA) plus a plurality of unsaturated monomers addition polymerizable with the vinyl compounds.

* * * * *